US011264703B2

(12) United States Patent
Cho et al.

(10) Patent No.: US 11,264,703 B2
(45) **Date of Patent: *Mar. 1, 2022**

(54) CHIP ANTENNA

(71) Applicant: Samsung Electro-Mechanics Co., Ltd., Suwon-Si (KR)

(72) Inventors: Sung Nam Cho, Suwon-si (KR); Sung Yong An, Suwon-si (KR); Jae Yeong Kim, Suwon-si (KR); Ju Hyoung Park, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/151,952

(22) Filed: Jan. 19, 2021

(65) Prior Publication Data

US 2021/0143527 A1 May 13, 2021

Related U.S. Application Data

(63) Continuation of application No. 16/743,453, filed on Jan. 15, 2020, now Pat. No. 10,938,091.

(30) Foreign Application Priority Data

Aug. 30, 2019 (KR) ..... 10-2019-0107437

(51) Int. Cl.

| | |
|---|---|
| ***H01Q 1/22*** | (2006.01) |
| ***H01Q 9/04*** | (2006.01) |
| ***H01Q 1/24*** | (2006.01) |

(52) U.S. Cl.
CPC ..... *H01Q 1/2283* (2013.01); *H01Q 1/243* (2013.01); *H01Q 9/0407* (2013.01)

(58) Field of Classification Search
CPC ..... H01Q 1/2283; H01Q 1/38; H01Q 21/065
USPC ..... 455/575.7
See application file for complete search history.

(56) References Cited

U.S. PATENT DOCUMENTS

| | | | | |
|---|---|---|---|---|
| 6,154,176 | A | 11/2000 | Fathy et al. | |
| 10,454,174 | B2 | 10/2019 | Yang | |
| 10,938,091 | B1 * | 3/2021 | Cho | H01Q 1/243 |
| 2019/0027802 | A1 | 1/2019 | Noori et al. | |
| 2020/0259267 | A1 | 8/2020 | Park et al. | |
| 2020/0313279 | A1 | 10/2020 | Kim et al. | |

FOREIGN PATENT DOCUMENTS

| | | |
|---|---|---|
| KR | 10-1163419 B1 | 7/2012 |
| KR | 10-1540223 B1 | 7/2015 |

* cited by examiner

*Primary Examiner* — Lee Nguyen
(74) *Attorney, Agent, or Firm* — NSIP Law

(57) ABSTRACT

A chip antenna includes a first ceramic substrate, a second ceramic substrate disposed to oppose the first ceramic substrate, a first patch, disposed on the first ceramic substrate, configured to operate as a feed patch, a second patch, disposed on the second ceramic substrate, configured to operate as a radiation patch, an insertion member disposed between the first ceramic substrate and the second ceramic substrate, and a shielding layer disposed on a side surface of the insertion member.

20 Claims, 15 Drawing Sheets

CHIP ANTENNA

CROSS-REFERENCE TO RELATED APPLICATIONS

This application is a continuation of U.S. patent application Ser. No. 16/743,453 filed on Jan. 15, 2020, now U.S. Pat. No. 10,938,091 issued Mar. 2, 2021, which claims the benefit under 35 USC 119(a) of Korean Patent Application No. 10-2019-0107437 filed on Aug. 30, 2019, in the Korean Intellectual Property Office, the entire disclosures of which are incorporated herein by reference for all purposes.

BACKGROUND

1. Field

The present disclosure relates to a chip antenna.

2. Description of the Background

Fifth generation (5G) communications systems may be implemented in high frequency bands (mmWave), between 10 GHz and 100 GHz, for example, to attain a high data transfer rate. To reduce loss of radio waves and to increase transmission distance, techniques such as beamforming, large-scale multiple-input multiple-output (MIMO), full dimensional multiple-input multiple-output (FD-MIMO), implementation of an array antenna, analog beamforming, and other large-scale antenna techniques have been considered in 5G communications systems.

Mobile communication terminals such as mobile phones, Personal Digital Assistants (PDAs), navigation devices, laptops, and the like, which support wireless communications have been designed to have functions such as Code Division Multiple Access (CDMA), wireless Local Area Network (LAN), Digital Multimedia Broadcasting (DMB), near field communication (NFC), and the like. One of the main components that enable such functions is an antenna.

However, it may be difficult to use a general-use antenna in the GHz bands applied in a 5G communications system, since wavelengths are as small as several millimeters in the GHz bands. Thus, a small-sized chip antenna module that can be mounted on a mobile communication device and can be used in GHz bands may be desired.

The above information is presented as background information only to assist with an understanding of the present disclosure. No determination has been made, and no assertion is made, as to whether any of the above might be applicable as prior art with regard to the disclosure.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a chip antenna includes a first ceramic substrate, a second ceramic substrate disposed to oppose the first ceramic substrate, a first patch, disposed on the first ceramic substrate, configured to operate as a feed patch, a second patch, disposed on the second ceramic substrate, configured to operate as a radiation patch, an insertion member disposed between the first ceramic substrate and the second ceramic substrate, and a shielding layer disposed on a side surface of the insertion member.

The shielding layer may be disposed on an entire side surface of the insertion member.

The shielding layer may extend in a circumferential direction of the insertion member, on the side surface of the insertion member.

A portion of the side surface of the insertion member may be exposed outside of the shielding layer.

The shielding layer may extend in a thickness direction of the insertion member, on the side surface of the insertion member.

The first patch may be disposed on one surface of the first ceramic substrate opposing the second ceramic substrate, and the second patch may be disposed on one surface of the second ceramic substrate opposing the first ceramic substrate.

The insertion member may include one or more of a spacer and a bonding layer disposed on the one surface of the first ceramic substrate and the one surface of the second ceramic substrate.

The shielding layer may be connected to a ground potential.

The shielding layer may be insulated from a ground potential to be floated.

The shielding layer may include one or more of one type selected from Cu, Ni, Ag, Sn, and Au, an alloy comprising two or more types of Cu, Ni, Ag, Sn, and Au, and a polymer having conductivity.

In another general aspect, a chip antenna includes a first ceramic substrate, a second ceramic substrate disposed to oppose the first ceramic substrate, a first patch, disposed on the first ceramic substrate, configured to receive a feed signal, a second patch disposed on the second ceramic substrate and coupled to the first patch, a first shielding layer disposed on a side surface of the first ceramic substrate, and a second shielding layer disposed on a side surface of the second ceramic substrate, wherein one of the first and second shielding layers is connected to a ground potential, and the other shielding layer is insulated from the ground potential to be floated.

The first shielding layer may be disposed on an entire side surface of the first ceramic substrate, and the second shielding layer may be disposed on an entire side surface of the second ceramic substrate.

The first shielding layer may extend in a circumferential direction of the first ceramic substrate, on the side surface of the first ceramic substrate, and the second shielding layer may extend in a circumferential direction of the second ceramic substrate, on the side surface of the second ceramic substrate.

The first shielding layer may extend in a thickness direction of the first ceramic substrate, on the side surface of the first ceramic substrate, and the second shielding layer may extend in a thickness direction of the second ceramic substrate, on the side surface of the second ceramic substrate.

The first shielding layer may be connected to the ground potential, and the second shielding layer may be floated.

Each of the first and second shielding layers may include one or more of one type selected from Cu, Ni, Ag, Sn, and Au, an alloy comprising two or more types of Cu, Ni, Ag, Sn, and Au, and a polymer having conductivity.

One or more of a spacer and a bonding layer may be disposed between the first ceramic substrate and the second ceramic substrate.

A mobile terminal may include the chip antenna disposed adjacent to an edge of the mobile terminal.

In another general aspect, a chip antenna includes a first substrate, a second substrate disposed to oppose the first substrate and spaced apart from the first substrate by an insertion member, a first patch, disposed on the first substrate, configured to operate as a feed patch, a second patch, disposed on the second substrate, configured to electromagnetically couple to the first patch, and one or more shielding layers disposed on a respective side surface of one or more of the first substrate, the second substrate, and the insertion member.

Other features and aspects will be apparent from the following detailed description, the drawings, and the claims.

BRIEF DESCRIPTION OF DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
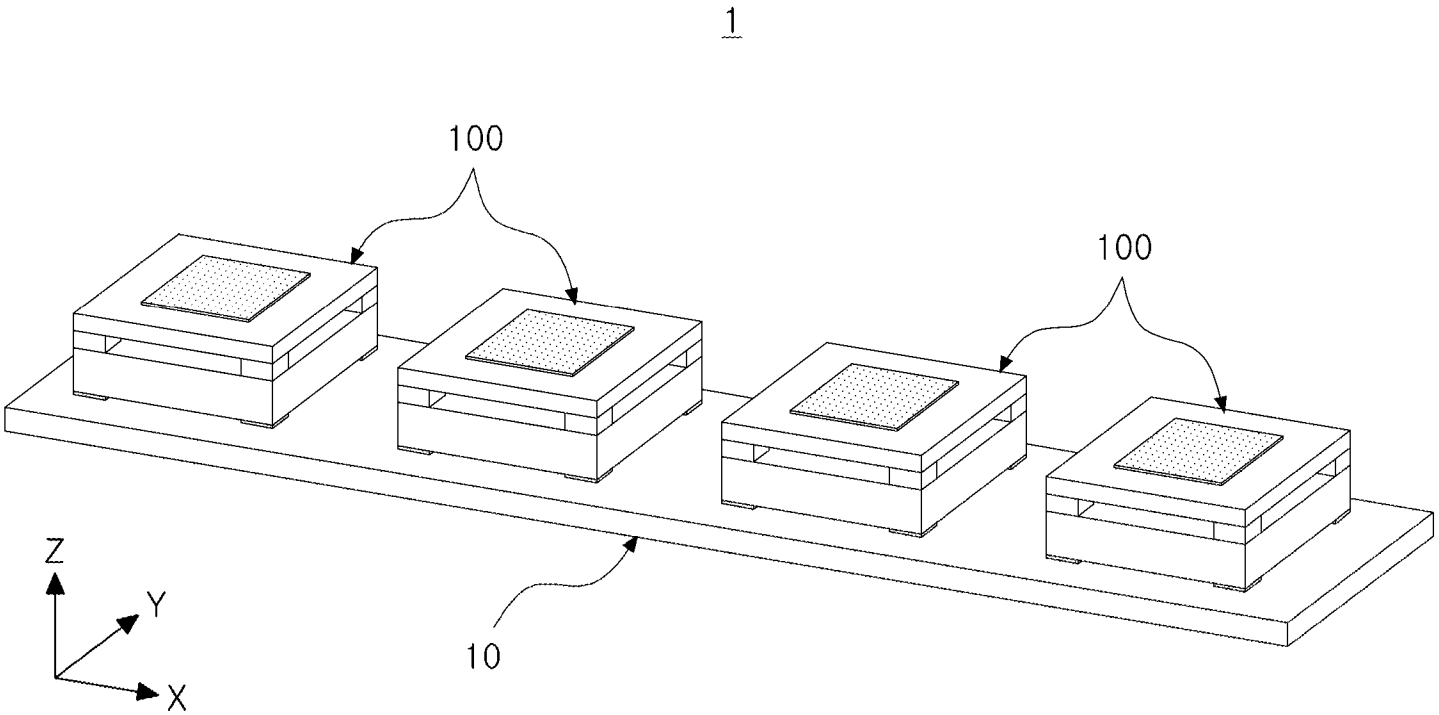
FIG. 1 is a perspective view of a chip antenna module according to an example.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of this disclosure. For example, the sequences of operations described herein are merely examples, and are not limited to those set forth herein, but may be changed as will be apparent after an understanding of this disclosure, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of this disclosure. Hereinafter, while embodiments of the present disclosure will be described in detail with reference to the accompanying drawings, it is noted that examples are not limited to the same.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween. As used herein "portion" of an element may include the whole element or less than the whole element.

As used herein, the term "and/or" includes any one and any combination of any two or more of the associated listed items; likewise, "at least one of" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes shown in the drawings may occur. Thus, the examples described herein are not limited to the specific shapes shown in the drawings, but include changes in shape that occur during manufacturing.

The features of the examples described herein may be combined in various ways as will be apparent after an understanding of this disclosure. Further, although the examples described herein have a variety of configurations, other configurations are possible as will be apparent after an understanding of this disclosure.

Herein, it is noted that use of the term "may" with respect to an example, for example, as to what an example may include or implement, means that at least one example exists in which such a feature is included or implemented while all examples are not limited thereto.

An aspect of the present disclosure is to provide a chip antenna which may reduce interference between chip antennas arranged in an array form.

A chip antenna module according to one or more examples disclosed herein, operates in a radio-frequency region. As an example, the chip antenna module may operate in a frequency band of 3 GHz or more. In addition, the chip antenna module according to one or more examples disclosed herein, may be mounted on an electronic device configured to receive or transmit and receive a radio-frequency (RF) signal. As an example, a chip antenna may be mounted on a mobile phone, a portable laptop computer, a vehicle, a drone, and the like, or a stationary structure and the like.

Figure 2A:
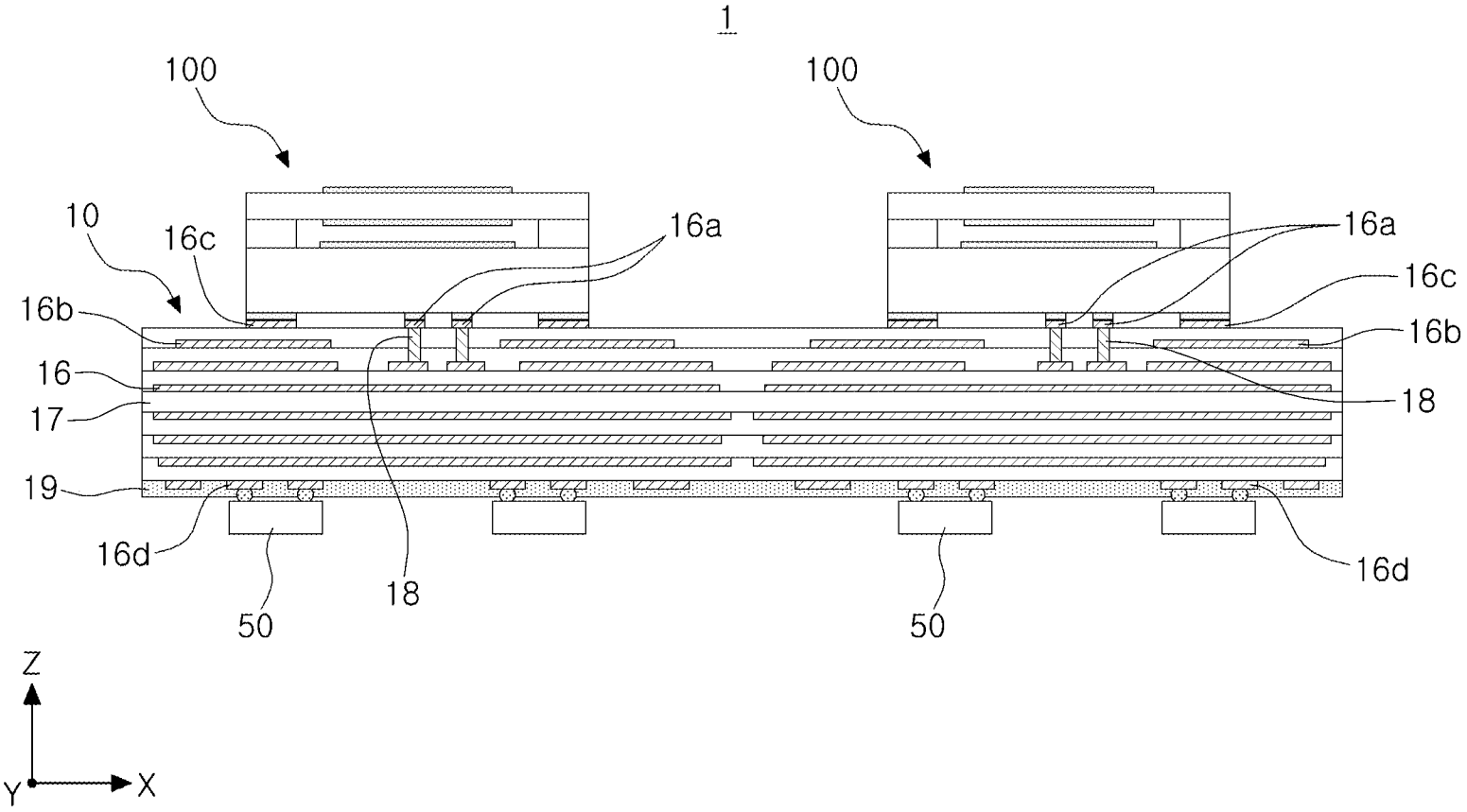
FIG. 2A is a cross-sectional view of a portion of the chip antenna module in FIG. 1.
Figure 2B:
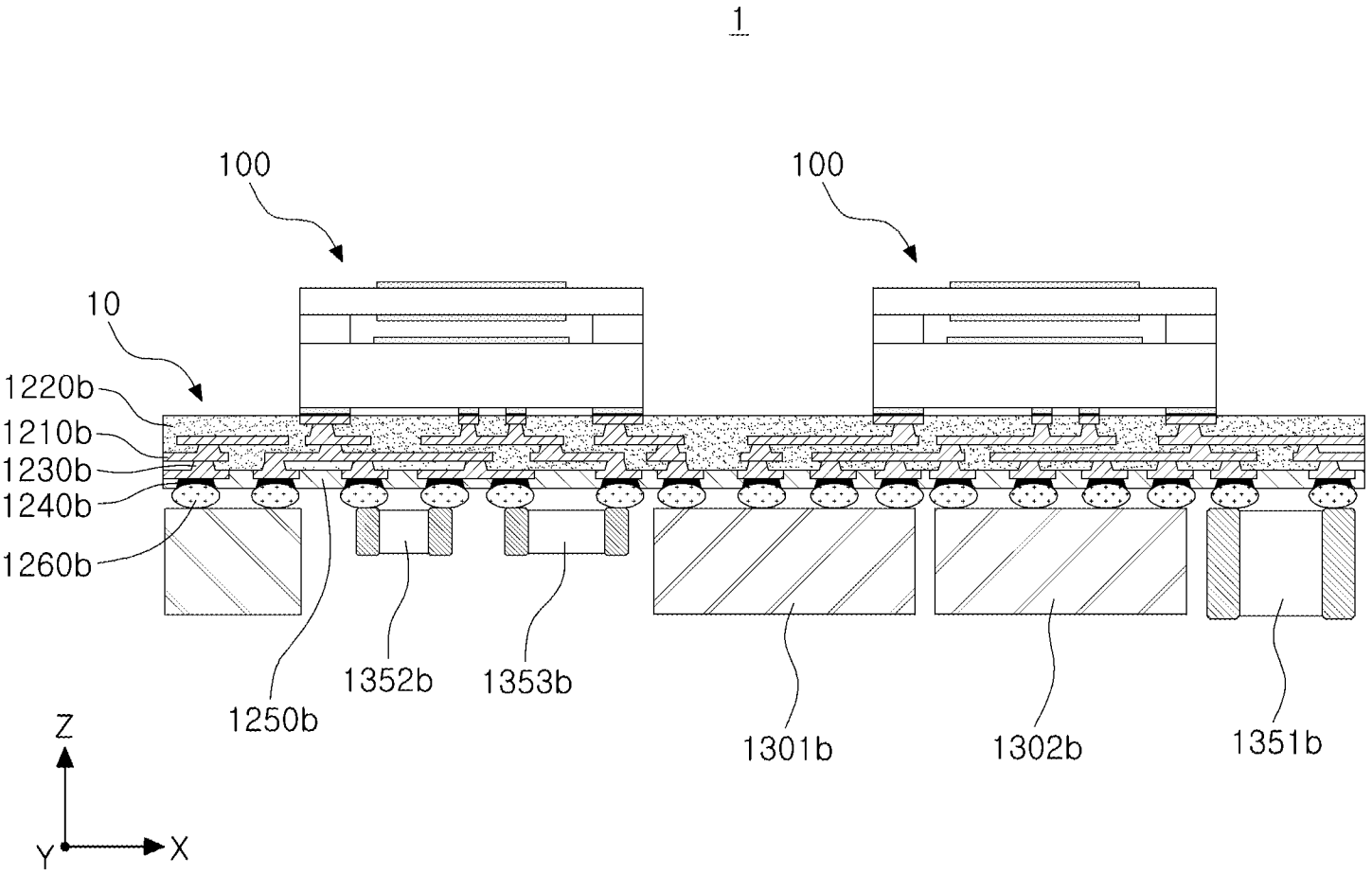
FIGS. 2B and 2C illustrate modified examples of the chip antenna module in FIG. 2A.
Figure 2C:
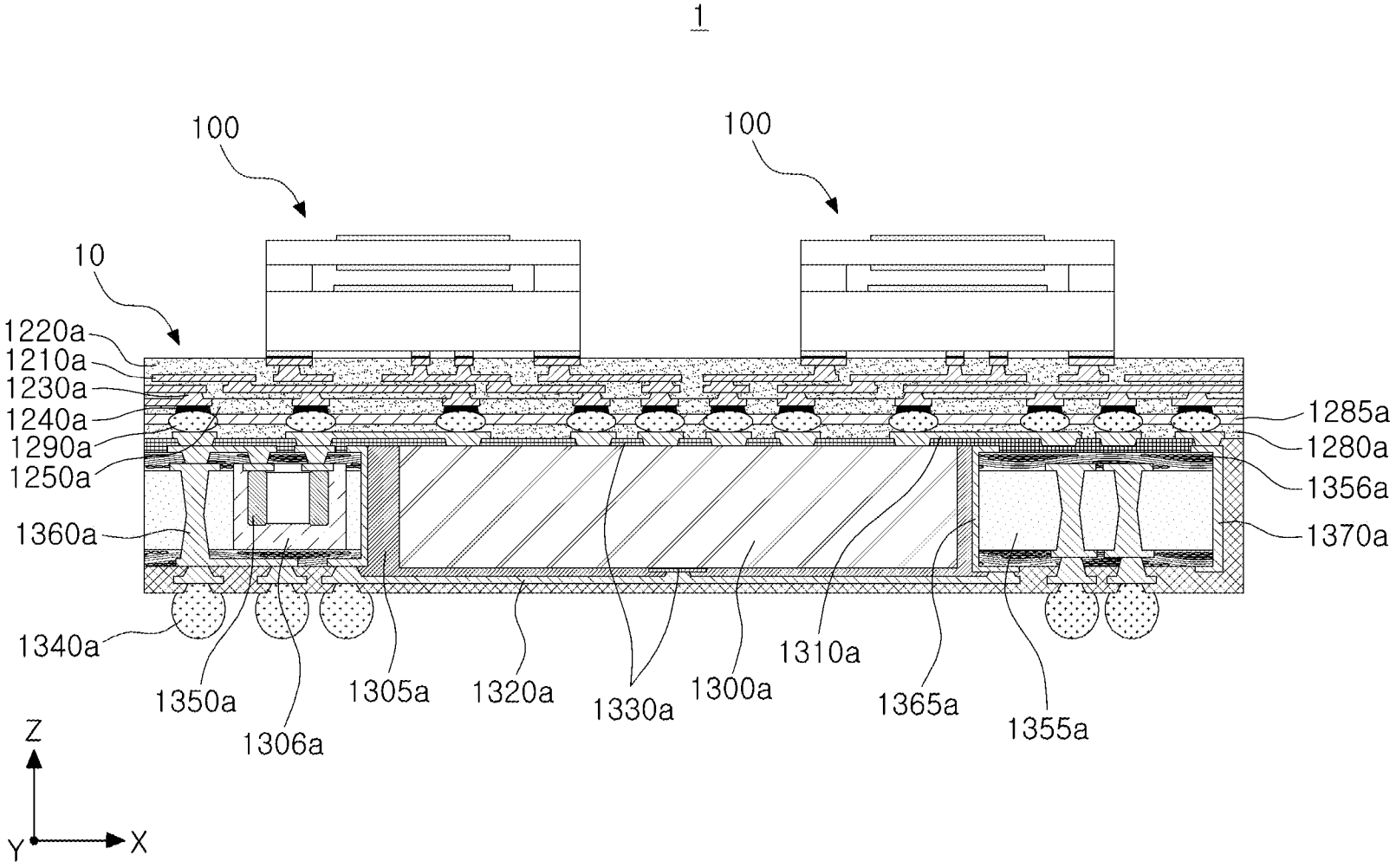
Figure 3A:
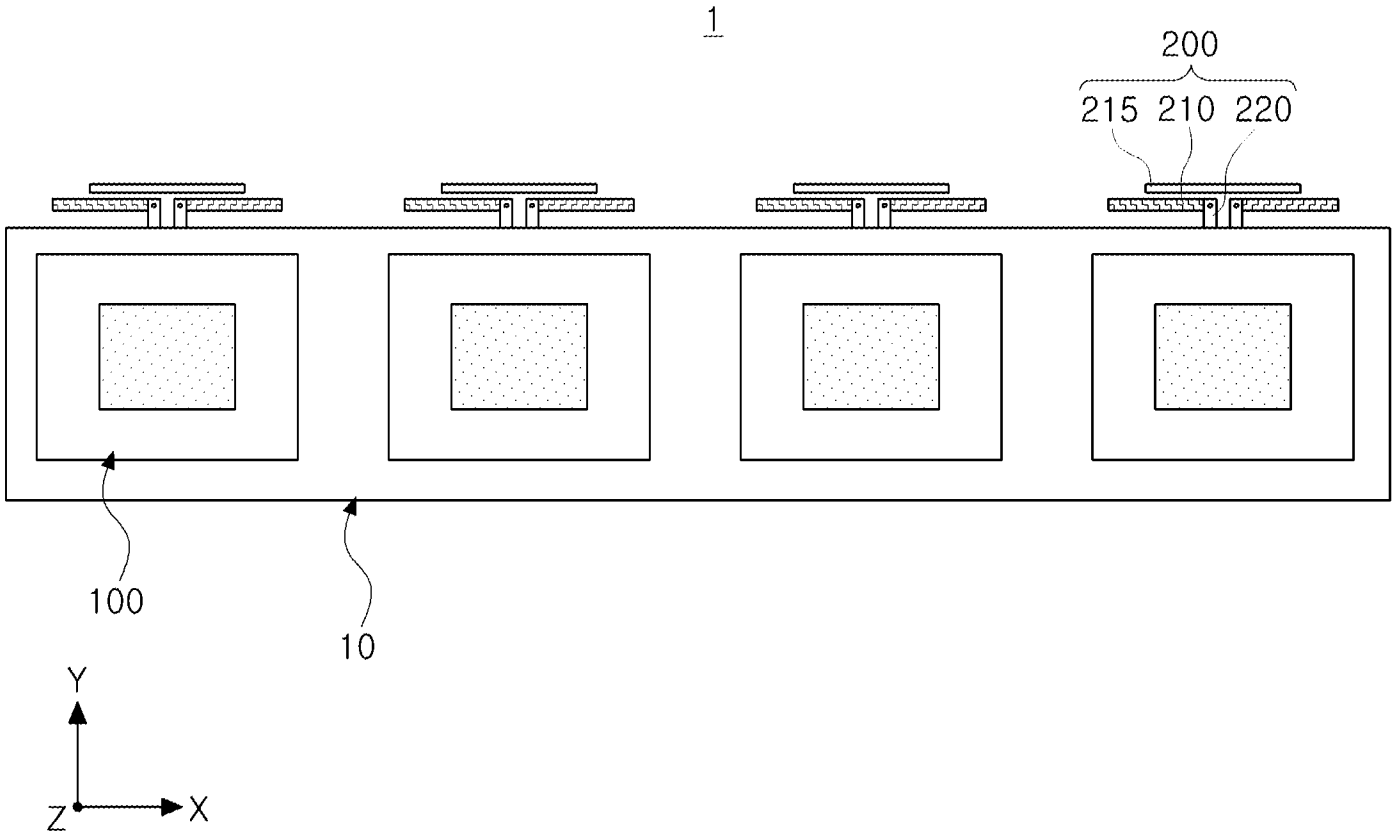
FIG. 3A is a plan view of the chip antenna module in FIG. 1.
Figure 3B:
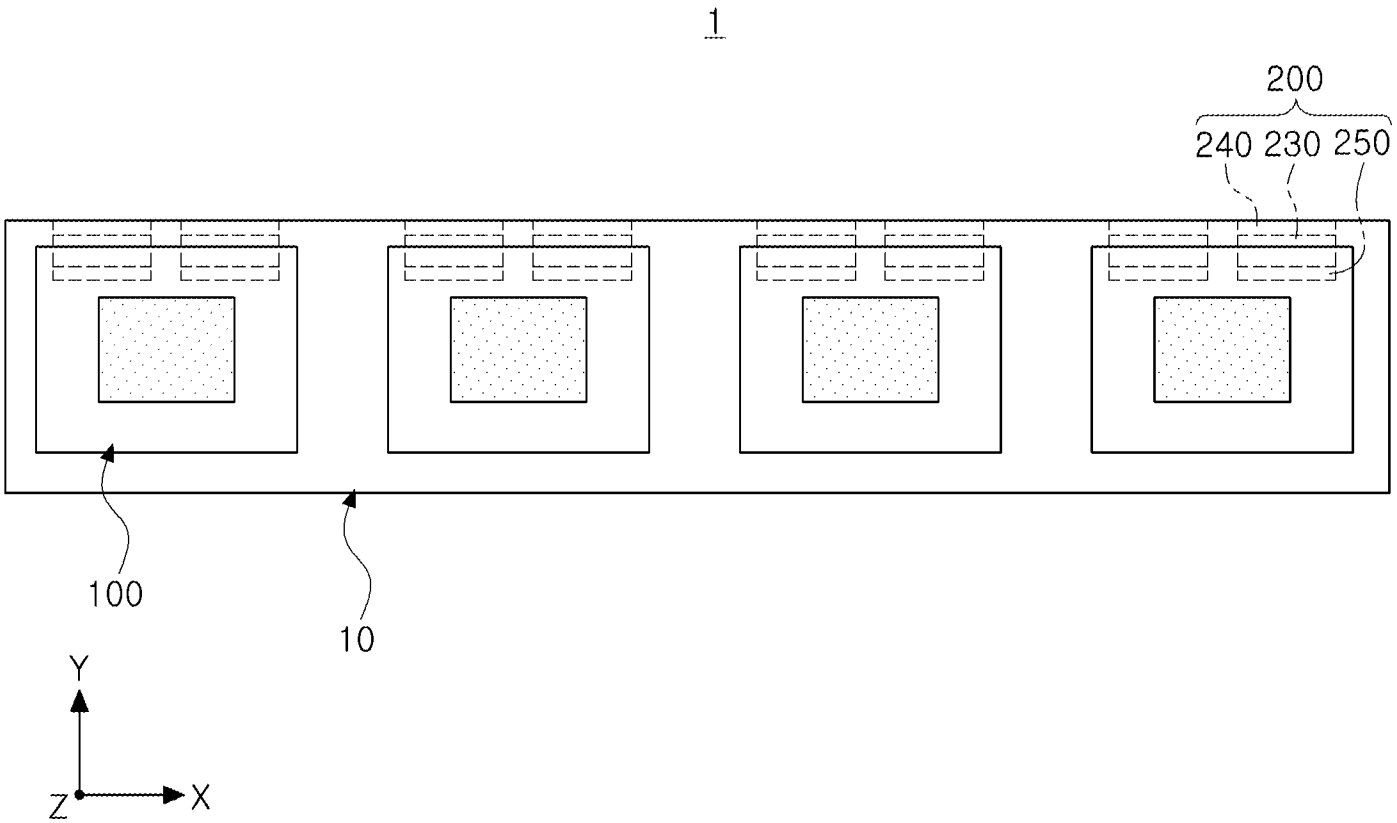
FIG. 3B illustrates a modified example of the chip antenna in FIG. 3A.

FIG. 1 is a perspective view of a chip antenna module according to an example, FIG. 2A is a cross-sectional view of a portion of the chip antenna module in FIG. 1, FIGS. 2B and 2C illustrate modified examples of the chip antenna module in FIG. 2A, FIG. 3A is a plan view of the chip antenna module in FIG. 1, and FIG. 3B illustrates a modified example of the chip antenna in FIG. 3A.

Referring to FIGS. 1, 2A, and 3A, a chip antenna module 1 according to an example includes a substrate 10, an electronic device 50, and a chip antenna 100 and may further include an end-fire antenna 200. One or more electronic devices 50, a plurality of chip antennas 100, and a plurality of end-fire antennas 200 may be disposed on the substrate 10.

The substrate 10 may be a circuit substrate on which a circuit or an electronic component required for the chip antenna 100 is mounted. For example, the substrate 10 may be a printed circuit board (PCB) having a surface on which one or more electronic components are mounted. Thus, the substrate 10 may include circuit wirings electrically connecting electronic components. The substrate 10 may be implemented as a flexible substrate, a ceramic substrate, a glass substrate, or the like. Specifically, the substrate 10 may be a multilayer substrate formed by alternately laminating at least one insulating layer 17 and at least one wiring layer 16. The at least one wiring layer 16 may include two external layers, provided on one surface and an opposing surface of the substrate 10, respectively, and at least one internal layer provided between the two external layers. As an example, the insulating layer 17 may be formed of an insulating material such as prepreg, Ajinomoto Build-up Film (ABF), FR-4, bismaleimide triazine (BT), or the like. The insulating material may be a thermosetting resin such as an epoxy resin, a thermoplastic resin such as a polyimide, a resin in which the thermosetting resin or the thermoplastic resin is impregnated together with an inorganic filler in a core material as a glass fiber (a glass cloth or a glass fabric). In some examples, the insulating layer 17 may be formed of a photosensitive insulating resin.

The wiring layer 16 may electrically connect the electronic device 50, the plurality of chip antennas 100, and the plurality of end-fire antennas 200 to each other. In addition, the wiring layer 16 may electrically connect a plurality of electronic devices 50, a plurality of chip antennas 100, and a plurality of end-fire antennas 200 to an external entity.

The wiring layer 16 may be formed of a conductive material such as copper (Cu), aluminum (Al), silver (Ag), tin (Sn), gold (Au), nickel (Ni), lead (Pb), titanium (Ti), or alloys thereof.

One or more wiring vias 18 may be disposed in the insulating layer to connect the wiring layers 16 to each other.

The chip antenna 100 may be mounted on one surface of the substrate 10, for example, on an upper surface of the substrate 10. The chip antenna 100 may have a width extending in a Y-direction, a length extending in an X-direction, intersecting, for example, perpendicular to the Y-direction, and a height extending in a Z-direction. As illustrated in FIG. 1, the chip antenna 100 may be arranged in a structure of n×1. The plurality of chip antennas 100 are arranged in the X-direction, such that widths of two chip antennas 100, adjacent to each other in the X-direction, among the plurality of chip antennas 100, may oppose each other.

According to an example, the chip antenna 100 may be arranged in a structure of n×m. The plurality of chip antennas 100 may be arranged in the X-direction and the Y-direction. In this case, lengths of two chip antennas, adjacent to each other, among the plurality of chip antennas 100, may oppose each other in the Y-direction, while widths of two chip antennas, adjacent to each other, among the plurality of chip antennas 100, may oppose each other in the X-direction.

Centers of chip antennas 100, adjacent to each other in at least one direction between the X-direction and the Y-direction, may be spaced apart from each other by $\lambda/2$ ($\lambda$ being a wavelength of an RF signal transmitted and received by the chip antennas 100).

When the chip antenna module 1 according to an example transmits and receives an RF signal in the 20 GHz to 40 GHz band, centers of chip antennas 100 adjacent to each other may be spaced apart from each other by 3.75 mm to 7.5 mm. When the chip antenna module 1 transmits and receives an RF signal in the 28 GHz band, the centers of chip antennas may be spaced apart from each other by 5.36 mm.

The RF signal, used in a 5G communications system, has a shorter wavelength and greater energy, as compared with an RF signal used in a third and/or fourth generation (3G/4G) communications system, in terms of characteristics. Thus, the chip antennas 100 need to have a sufficient separation distance in order to significantly reduce interference between RF signals transmitted and received by respective ones of the chip antennas 100.

According to an example, centers of chip antennas 100 may be sufficiently spaced apart from each other by $\lambda/2$ to significantly reduce interference of RF signals transmitted and received by the chip antennas 100. Thus, the chip antenna 100 may be used in the 5G communications system.

According to an example, a spaced distance between centers of chip antennas 100 adjacent to each other may be smaller than $\lambda/2$. As will be described later, each of the chip antennas 100 is configured as at least one patch provided in ceramic substrates and a portion of ceramic substrates. In this case, ceramic substrates are spaced apart from each other by a predetermined distance, or a material having a dielectric constant lower than a dielectric constant of ceramic substrates is disposed between the ceramic substrates, such that overall dielectric constant of the chip antenna 100 may be reduced. Thus, a wavelength of an RF signal transmitted and received by the chip antenna 100 may be increased to improve the radiation efficiency and gain. Thus, even when adjacent chip antennas 100 are arranged to allow a spaced distance between centers of chip antennas 100 adjacent to each other to be smaller than λ/2 of the RF signal, interference between RF signals may be significantly reduced. When the chip antenna module 1 according to an example transmits and receives an RF signal in the 28 GHz band, a spaced distance between centers of chip antennas 100 adjacent to each other may be smaller than 5.36 mm.

A feed pad 16*a* may be provided on an upper surface of the substrate 10 to provide a feed signal to the chip antenna 100. A ground layer 16*b* is provided in any one internal layer among a plurality of layers of the substrate 10. As an example, the wiring layer 16, disposed in a lower layer which is the most adjacent to an upper surface of the substrate 10, is used as a ground layer 16*b*. The ground layer 16*b* operates as a reflector of the chip antenna 100. Thus, the ground layer 16*b* may reflect the RF signal, output by the chip antenna 100, in the Z-direction corresponding to an oriented direction to concentrate an RF signal.

In FIG. 2A, the ground layer 16*b* is illustrated as being disposed on a lower layer which is the most adjacent to an upper surface of the substrate 10. However, according to an example, the ground layer 16*b* may be provided on an upper surface of the substrate 10 and may be provided on another layer.

In addition, a top pad 16*c*, bonded to the chip antenna 100, is provided on an upper surface of the substrate 10. The electronic device 50 may be mounted on the opposing surface of the substrate 10, for example, on a lower surface. A bottom pad 16*d*, electrically connected to the electronic device 50, is provided on a lower surface of the substrate 10.

An insulating protective layer 19 may be disposed on the lower surface of the substrate 10. The insulating protective layer 19 is disposed in the form of covering the insulating layer 17 and the wiring layer 16 on a lower surface of the substrate 10, and protects the wiring layer 16 disposed on a lower surface of the insulating layer 17. As an example, the insulating protective layer 19 may include an insulating resin and an inorganic filler. The insulating protective layer 19 may have an opening exposing at least a portion of the wiring layer 16. The electronic device 50 may be mounted on the bottom pad 16*d* through a solder ball disposed in the opening.

FIGS. 2B and 2C illustrate modified example of the chip antenna module in FIG. 2A.

Chip antenna modules according to examples in FIGS. 2A and 2B are similar to the chip antenna module in FIG. 2A, so further duplicative explanations may be omitted and differences will be mainly described.

Referring to FIG. 2B, a substrate 10 includes at least one wiring layer 1210*b*, at least one insulating layer 1220*b*, a wiring via 1230*b* connected to the at least one wiring layer 1210*b*, a connection pad 1240*b* connected to the wiring via 1230*b*, and a solder resist layer 1250*b*. The substrate 10 may have a structure similar to a structure of a copper redistribution layer (RDL). A chip antenna 100 may be disposed on an upper surface of the substrate 10.

An integrated circuit chip (IC) 1301*b*, a power management integrated chip (PMIC) 1302*b*, and a plurality of passive components 1351*b*, 1352*b*, and 1353*b* may be mounted on a lower surface of a substrate through the solder ball 1260*b*. The IC 1301*b* corresponds to an IC for operating the chip antenna module 1. The PMIC 1302*b* generates power, and the generated power may be transmitted to the IC 1301*b* through the at least one wiring layer 1210*b* of the substrate 10.

The plurality of passive components 1351*b*, 1352*b*, and 1353*b* may provide impedance to the IC 1301*b* and/or the PMIC 1302*b*. For example, the plurality of passive components 1351*b*, 1352*b*, and 1353*b* may include at least a portion of a capacitor such as a multilayer ceramic capacitor (MLCC), an inductor, and a chip resistor.

Referring to FIG. 2C, the substrate 10 may include at least one wiring layer 1210*a*, at least one insulating layer 1220*a*, a wiring via 1230*a*, a connection pad 1240*a*, and a solder resist layer 1250*a*.

An electronic component package is mounted on a lower surface of the substrate 10. The electronic component package may include an IC 1300*a*, an encapsulant 1305*a* sealing at least a portion of the IC 1300*a*, a supporting member 1355*a* having a first side surface opposing the IC 1300*a*, at least one wiring layer 1310*a* electrically connected to the IC 1300*a* and the supporting member 1355*a*, and a connection member including an insulating layer 1280*a*.

An RF signal, generated by the IC 1300*a*, may be transmitted to the substrate 10 through at least one wiring layer 1310*a* to be transmitted in a direction of an upper surface of the chip antenna module 1. An RF signal, received by the chip antenna module 1, may be transmitted to the IC 1300*a* through at least one wiring layer 1310*a*.

The electronic component package may further include a connection pad 1330*a* disposed on one surface and/or another surface of the IC 1300*a*, for example, the other surface opposes the one surface. A connection pad 1330*a*, disposed on the one surface of the IC 1300*a*, may be electrically connected to at least one wiring layer 1310*a*, while a connection pad 1330*a*, disposed on the other surface of the IC 1300*a*, may be electrically connected to the supporting member 1355*a* or a core plating member 1365*a* through a bottom wiring layer 1320*a*. The core plating member 1365*a* may provide ground to the IC 1300*a*.

The supporting member 1355*a* may include a core dielectric layer 1356*a*, and at least one core via 1360*a* penetrating through the core dielectric layer 1356*a* and electrically connected to the bottom wiring layer 1320*a*. The at least one core via 1360*a* may be electrically connected to an electrical connection structure 1340*a* such as a solder ball, a pin, or a land. Thus, the supporting member 1355*a* receives a base signal or power from a lower surface of the substrate 10 to transmit the base signal or power to the IC 1300*a* through at least one wiring layer 1310*a*.

The IC 1300*a* may generate an RF signal in a millimeter wave (mmWave) band using the base signal and/or power. For example, the IC 1300*a* receives a base signal having a low frequency and performs frequency conversion of the base signal, amplification, filtering phase control, and power generation. The IC 1300*a* may be formed as one between a compound semiconductor (for example, GaAs) and a silicon semiconductor, in order to implement high-frequency characteristics. The electronic component package may further include a passive component 1350*a* electrically connected to at least one wiring layer 1310*a*. The passive component 1350*a* may be disposed in an accommodation space 1306*a* provided by the supporting member 1355*a*. The passive component 1350*a* may include at least a portion of a ceramic capacitor (for example, a multilayer ceramic capacitor, MLCC), an inductor, or a chip resistor.

The electronic component package may include core plating members 1365*a* and 1370*a* disposed on a side surface of the supporting member 1355*a*. The core plating members 1365*a* and 1370*a* may provide ground to the IC 1300*a*, and may dissipate heat of the IC 1300*a* outwardly thereof or remove noise flowing into the IC 1300*a*.

Each of a configuration of an electronic component package except a connection member, and a connection member may be independently manufactured and then combined with each other, but may be manufactured together depending on a design. In FIG. 2C, an electronic component package is illustrated as being combined with the substrate 10 through an electrical connection structure 1290*a* and a solder resist layer 1285*a*. However, according to an example, the electrical connection structure 1290*a* and the solder resist layer 1285*a* may be omitted.

Referring to FIG. 3A, the chip antenna module 1 may further include at least one end-fire antenna 200. Each end-fire antenna 200 may include an end-fire antenna pattern 210, a director pattern 215, and an end-fire feedline 220.

The end-fire antenna pattern 210 may transmit or receive an RF signal in a direction of a side surface. The end-fire antenna pattern 210 may be disposed in a side surface of the substrate 10, and may be provided in the form of a dipole or in the form of a folded dipole. The director pattern 215 may be electromagnetically coupled to an end-fire antenna pattern 210 to improve the gain or bandwidth of the plurality of end-fire antenna patterns 210. The end-fire feedline 220 may transmit the RF signal, received from the end-fire antenna pattern 210, to the electronic device or IC and may transmit the RF signal, received from the electronic device or IC, to the end-fire antenna pattern 210.

The end-fire antenna 200, formed by a wiring pattern of FIG. 3A, may be implemented as an end-fire antenna 200 in the form of a chip, as illustrated in FIG. 3B.

Referring to FIG. 3B, each end-fire antenna 200 includes a body portion 230, a radiating unit 240, and a grounding unit 250.

The body portion 230 may have a hexahedral shape, and be formed of a dielectric substance. For example, the body portion 230 may be formed of a polymer or a ceramic sintered material having a predetermined dielectric constant.

The radiating unit 240 is bonded to a first surface of the body portion 230, and the grounding unit 250 is bonded to a second surface, opposing the first surface of the body portion 230. The radiating unit 240 and the grounding unit 250 may be formed of the same material. The radiating unit 240 and the grounding unit 250 may be formed of one type selected from Ag, Au, Cu, Al, Pt, Ti, Mo, Ni, W, or alloys formed of two or more types. The radiating unit 240 and the grounding unit 250 may be formed to have the same shape or the same structure. The radiating unit 240 and the grounding unit 250 may be divided according to the type of the pad to be bonded, when mounted on the substrate 10. As an example, a portion bonded to a feed pad may function as the radiating unit 240, and a portion bonded to a ground pad may function as the grounding unit 250.

Since the end-fire antenna 200 in the form of a chip has capacitance due to a dielectric substance between the radiating unit 240 and the grounding unit 250, a coupling antenna may be designed, or a resonant frequency may be tuned, using the capacitance.

Conventionally, multiple layers were required in a substrate such that a patch antenna, implemented in the form of a pattern inside a multilayer board, secures sufficient antenna characteristics. However, this caused a volume of a patch antenna to be significantly increased, which was addressed by a method in which an insulator having a high dielectric constant was disposed inside a multilayer board, a thickness of the insulator was reduced, and a size and a thickness of an antenna pattern were reduced.

However, when the dielectric constant of the insulator is increased, a wavelength of an RF signal may be shortened to cause the RF signal to be blocked by an insulator having a high dielectric constant. Thus, the radiation efficiency and gain of the RF signal may be significantly reduced.

According to an example, a patch antenna, which was conventionally implemented in the form of a pattern in a multilayer board, may be implemented in the form of a chip to significantly reduce the number of layers of a substrate with a chip antenna mounted thereon. As a result, the manufacturing costs and volume of the chip antenna module 1 according to the example may be reduced.

In addition, according to an example, a dielectric constant of ceramic substrates, provided in the chip antenna 100, may be formed higher than a dielectric constant of an insulating layer, provided in the substrate 10, to achieve miniaturization of the chip antenna 100.

Furthermore, ceramic substrates of the chip antenna 100 may be spaced apart from each other by a predetermined distance or a material, having a dielectric constant lower than a dielectric constant of the ceramic substrates, may be disposed between the ceramic substrates. Thus, an overall dielectric constant of the chip antenna 100 may be reduced to increase a wavelength of an RF signal while miniaturizing the chip antenna 100. As a result, the radiation efficiency and gain may be improved. The "overall dielectric constant of the chip antenna 100" refers to a dielectric constant formed by ceramic substrates of the chip antenna 100 and a gap between the ceramic substrates or a dielectric constant formed by ceramic substrates of the chip antenna 100 and a material disposed between the ceramic substrates. Therefore, when ceramic substrates of the chip antenna 100 are spaced apart from each other by a predetermined distance or a material having a dielectric constant lower than that of the ceramic substrates is disposed between the ceramic substrates, an overall dielectric constant of the chip antenna 100 may be lower than that of the ceramic substrates.

Figure 4A:
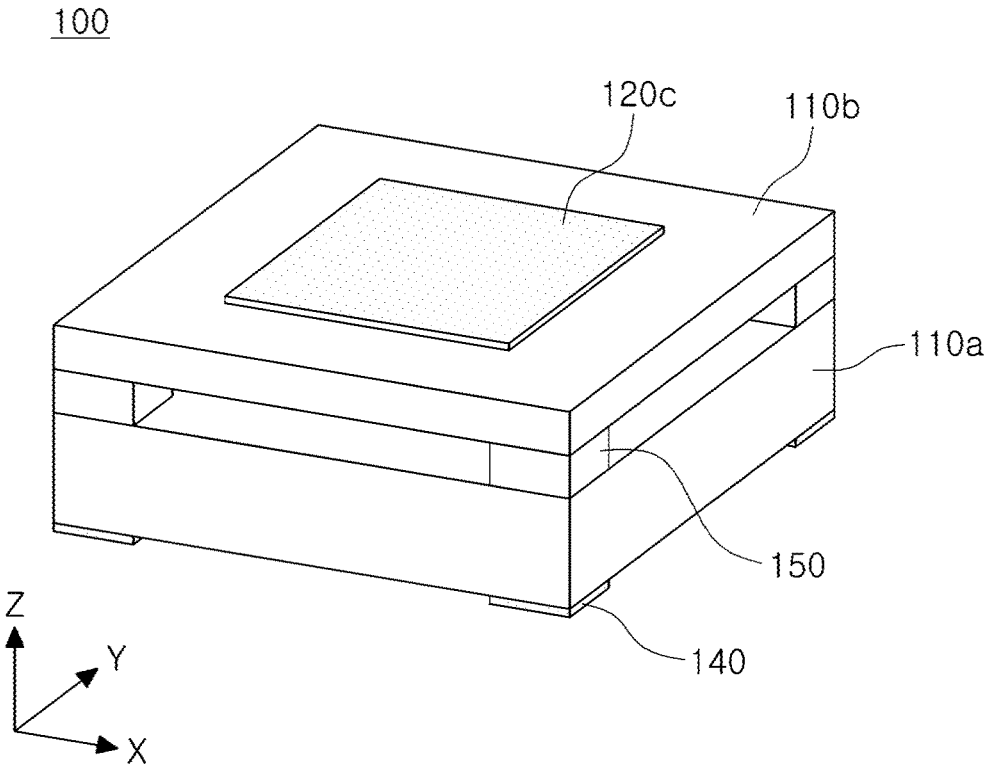
FIG. 4A is a perspective view of a chip antenna according to a first example.
Figure 4B:
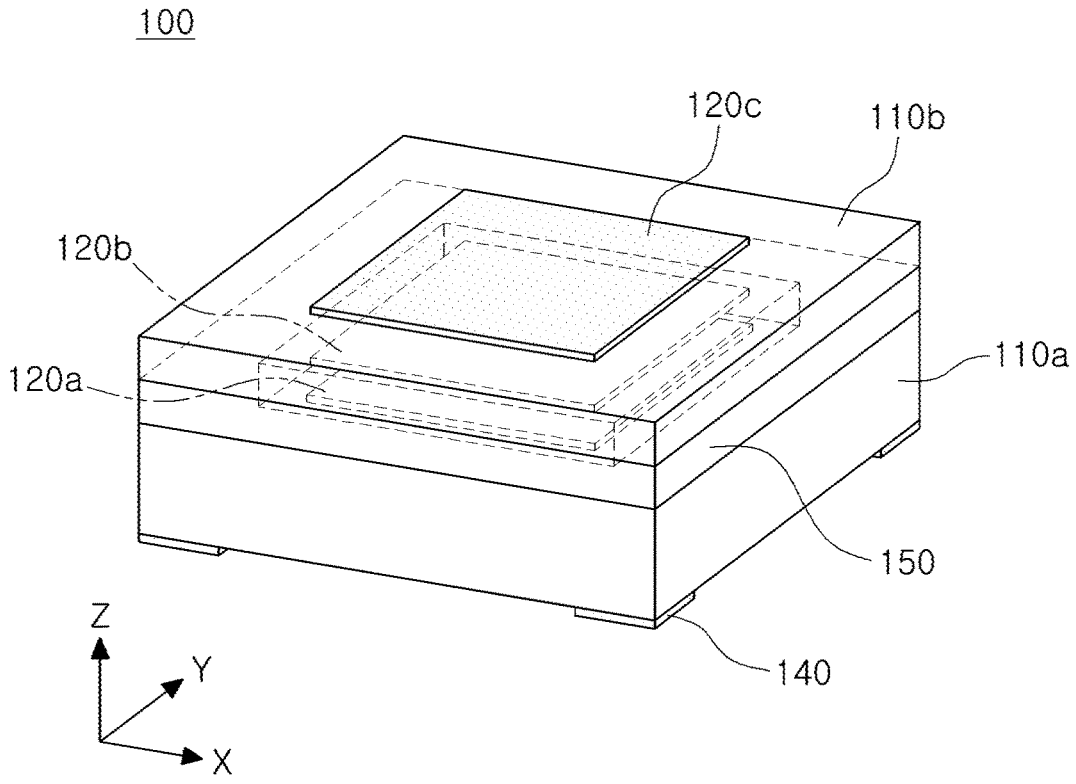
FIG. 4B is a perspective view illustrating a modified example of the chip antenna according to the first example.
Figure 4C:
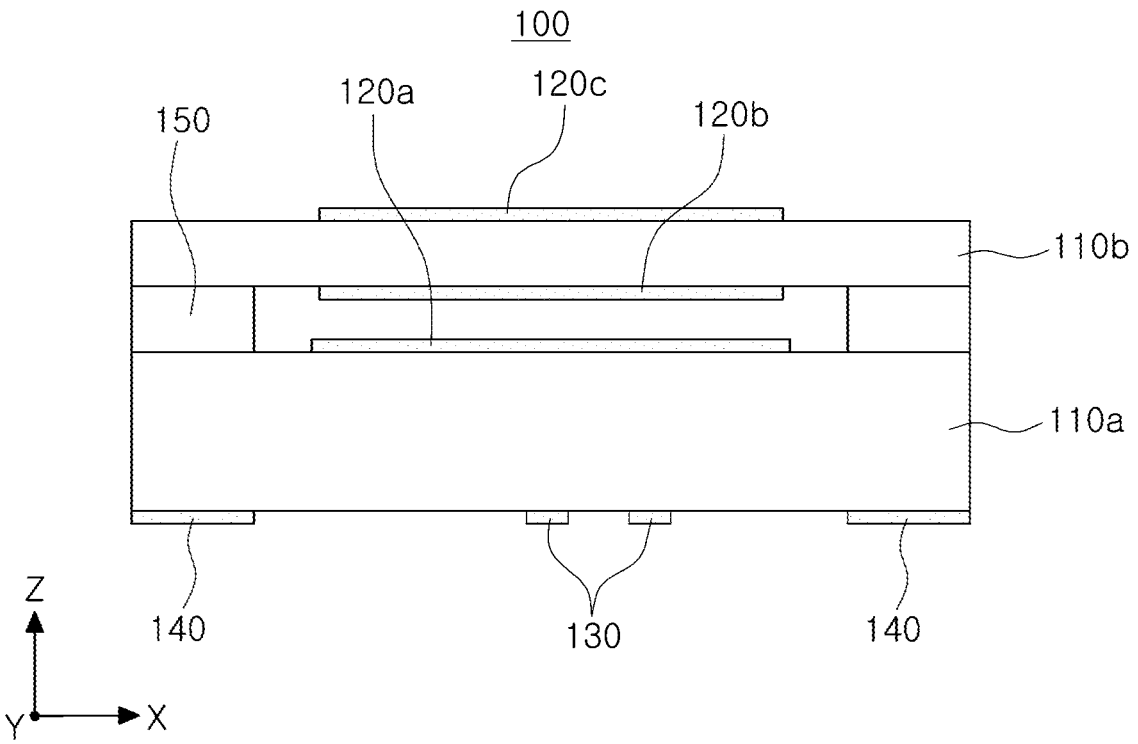
FIG. 4C is a side view of the chip antenna in FIG. 4A.
Figure 4D:
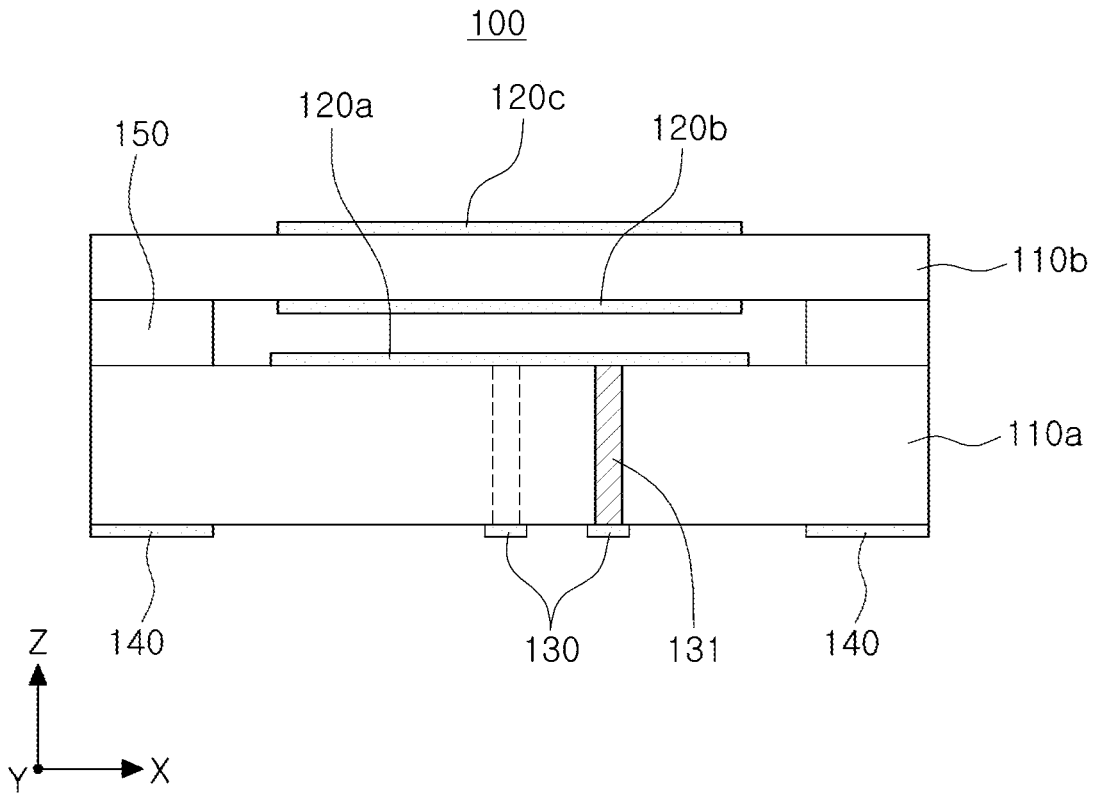
FIG. 4D is a cross-sectional view of the chip antenna in FIG. 4A.
Figure 4E:
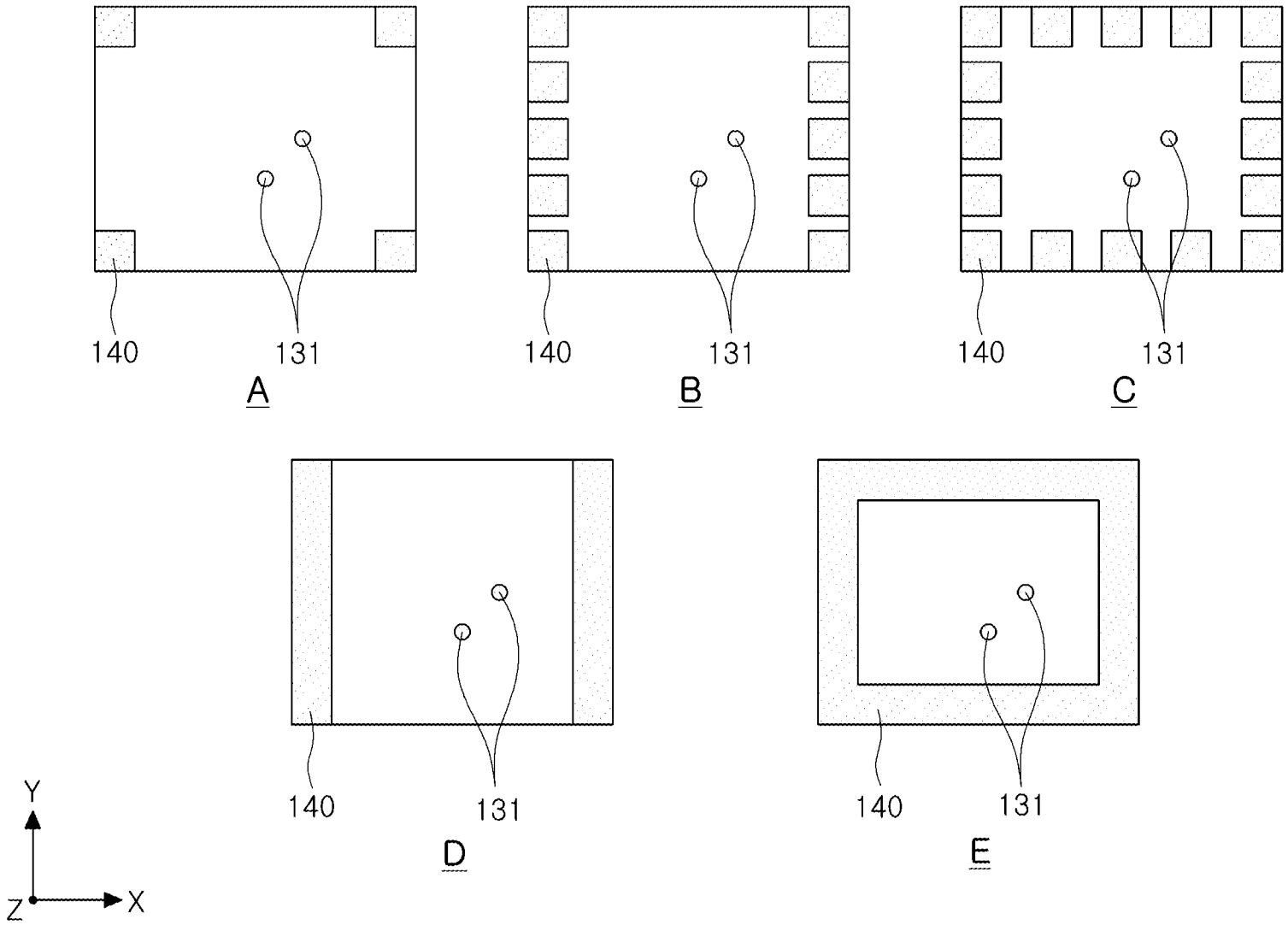
FIG. 4E is a bottom view of the chip antenna in FIG. 4A.

FIG. 4A is a perspective view of a chip antenna according to a first example, FIG. 4B is a perspective view illustrating a modified example of the chip antenna according to the first example, FIG. 4C is a side view of the chip antenna in FIG. 4A, FIG. 4D is a cross-sectional view of the chip antenna in FIG. 4A, and FIG. 4E is a bottom view of the chip antenna in FIG. 4A.

Referring to FIGS. 4A, 4B, 4C, and 4D, a chip antenna 100 according to a first example includes a first ceramic substrate 110*a*, a second ceramic substrate 110*b*, and a first patch 120*a*, and may include at least one of a second patch 120*b* and a third patch 120*c*. For example, the chip antenna 100 may include the first patch 120*a* and the second patch 120*b*, the first patch 120*a* and the third patch 120*c*, or the first patch 120*a*, the second patch 120*b*, and the third patch 120*c*.

The first patch 120*a* may be formed of a metal in the form of a flat plate having a constant area. As an example, the first patch 120*a* may have a quadrangular shape. However, according to an example, the first patch may have various shapes such as a polygonal shape, a circular shape, and the like. The first patch 120*a* may be connected to a feed via 131 to function and operate as a feed patch.

The second patch 120*b* and the third patch 120*c* are spaced apart from the first patch 120*a* by a predetermined distance, and may be formed of a metal in the form of a flat plate having a constant area. The second patch 120*b* and the third patch 120*c* may have an area the same as or different from that of the first patch 120*a*. As an example, the second patch 120*b* and the third patch 120*c* may be formed to have an area smaller than the first patch 120*a* and may be disposed in an upper portion above the first patch 120*a*. As an example, the second patch 120*b* and the third patch 120*c* may be formed smaller than the first patch 120*a* by 5% to 8%. As an example, each of the first patch 120*a*, the second patch 120*b*, and the third patch 120*c* may have a thickness of 20 μm (microns).

The second patch 120*b* and the third patch 120*c* may be electromagnetically coupled to the first patch 120*a* to function and operate a radiation patch. The second patch 120*b* and the third patch 120*c* may further concentrate an RF signal in a Z direction, corresponding to a mounting direction of the chip antenna 100, to improve the gain or bandwidth of the first patch 120*a*. The chip antenna 100 may include at least one of the second patch 120*b* and the third patch 120*c* functioning as a radiation patch.

The first patch 120*a*, the second patch 120*b*, and the third patch 120*c* may be formed of one selected from Ag, Au, Cu, Al, Pt, Ti, Mo, Ni, W, or alloys formed of two or more types. In addition, the first patch 120*a*, the second patch 120*b*, and the third patch 120*c* may be formed of a conductive paste or a conductive epoxy.

According to an example, a plating layer may be additionally formed along a surface of each of the first patch 120*a*, the second patch 120*b*, and the third patch 120*c* to have a rod shape. The plating layer may be formed on a surface of each of the first patch 120*a*, the second patch 120*b*, and the third patch 120*c* through a plating process. The plating layer may be formed by sequentially laminating a nickel (Ni) layer and a tin (Sn) layer, or by sequentially laminating a zinc (Zn) layer and a tin (Sn) layer. According to an example, the plating layer may be formed of one selected from copper (Cu), nickel (Ni), and tin (Sn), or alloys formed of two or more thereof.

The plating layer may be formed on each of the first patch 120*a*, the second patch 120*b*, and the third patch 120*c* to prevent oxidation of the first patch 120*a*, the second patch 120*b*, and the third patch 120*c*. In addition, the plating layer may be formed along surfaces of a feed pad 130, a bonding pad 140, and a spacer 150 to be described later.

The first ceramic substrate 110*a* may be formed of a dielectric substance having a predetermined dielectric constant. As an example, the first ceramic substrate 110*a* may be formed of a ceramic sintered material having a cubic shape. The first ceramic substrate 110*a* may include magnesium (Mg), silicon (Si), aluminum (Al), calcium (Ca), and titanium (Ti). As an example, the first ceramic substrate 110*a* may include $Mg_2SiO_4$, $MgAl_2O_4$, and $CaTiO_3$. As another example, the first ceramic substrate 110*a* may further include $MgTiO_3$ other than $Mg_2SiO_4$, $MgAl_2O_4$, and $CaTiO_3$. According to an example, $CaTiO_3$ is replaced with $MgTiO_3$, and thus, the first ceramic substrate 110*a* may include $Mg_2SiO_4$, $MgAl_2O_4$, and $MgTiO_3$.

When a distance between the ground layer 16*b* of the chip antenna module 1 and the first patch 120*a* of the chip antenna 100 corresponds to λ/10 to λ/20, the ground layer 16*b* may efficiently reflect an RF signal, output by the chip antenna 100, in an oriented direction.

When the ground layer 16*b* is provided on an upper surface of the substrate 10, a distance between the ground layer 16*b* of the chip antenna module 1 and the first patch 120*a* of the chip antenna 100 is substantially equal to the sum of a thickness of the first ceramic substrate 110*a* and a thickness of the connection pad 140.

Accordingly, the thickness of the first ceramic substrate 110*a* may be determined depending on a design distance (λ/10 to λ/20) between the ground layer 16*b* and the first patch 120*a*. As an example, the thickness of the first ceramic substrate 110*a* may correspond to 90% to 95% of λ/10 to λ/20. As an example, when a dielectric constant of the first ceramic substrate 110*a* is 5 to 12 at 28 GHz, a thickness of the first ceramic substrate 110*a* may be 150 μm to 500 μm.

A first patch 120*a* is provided on one surface of the first ceramic substrate 110*a*, and a feed pad 130 is provided on another surface of the first ceramic substrate 110*a*, for example, the other surface opposes the one surface. At least one feed pad 130 may be provided on the other surface of the first ceramic substrate 110*a*. The feed pad 130 may have a thickness of 20 μm.

The feed pad 130, provided on the other surface of the first ceramic substrate 110*a*, may be electrically connected to the feed pad 16*a* provided on the one surface of the substrate 10. The feed pad 130 may be electrically connected to the feed via 131 penetrating through the first ceramic substrate 110*a* in a thickness direction, and the feed via 131 may provide a feed signal to the first patch 120*a* provided on the one surface of the first ceramic substrate 110*a*. At least one feed via 131 may be provided. As an example, two feed vias 131 may be provided to correspond to two feed pads 130. One feed via 131, of two feed vias 131, may correspond to a feed line for generating vertical polarization, and the other feed via 131 may correspond to a feed line for generating horizontal polarization. The feed via 131 may have a diameter of 150 μm. A connection pad 140 is provided on the other surface of the first ceramic substrate 110*a*. The connection pad 140, provided on the other surface of the first ceramic substrate 110*a*, may be bonded to a top pad 16*c* provided on the one surface of the substrate 10. As an example, the connection pad 140 of the chip antenna 100 may be bonded to the top pad 16*c* of the substrate 10 through a solder paste. The bonding pad 140 may have a thickness of 20 μm.

Referring to 'A' of FIG. 4E, a plurality of bonding pads 140 may be provided, and may be provided on respective corners of a quadrilateral shape on the other surface of the first ceramic substrate 110*a*.

Referring to 'B' of FIG. 4E, a plurality of bonding pads 140 may be provided along one side of a quadrilateral shape and another side opposing the one side, to be spaced apart from each other by a predetermined distance, on the other surface of the first ceramic substrate 110*a*.

Referring to 'C' of FIG. 4E, a plurality of bonding pads 140 may be provided along four respective sides of a quadrilateral shape to be spaced apart from each other, on the other surface of the first ceramic substrate 110*a*.

Referring to 'D' of FIG. 4E, a bonding pad 140 may be provided on each of the one side of a quadrilateral shape and the other side opposing the one side, to have a length corresponding to the one side and the other side, respectively, on the other surface of the first ceramic substrate 110*a*.

Referring to 'E' of FIG. 4E, a bonding pad 140 may be provided along four respective sides of a quadrilateral shape to have a length along each side corresponding to the respective side, on the other surface of the first ceramic substrate 110*a*.

In 'A', 'B', and 'C' of FIG. 4E, each of the bonding pads 140 is illustrated as having a quadrilateral shape. However, according to an example, each of the bonding pads 140 may have various shapes such as a circle. In 'A', 'B', 'C', 'D', and 'E' of FIG. 4E, the bonding pads 140 are illustrated as being disposed adjacent to four sides of a quadrilateral shape. However, according to an example, the bonding pads 140 may be disposed to be spaced apart from the four sides by a predetermined distance.

The second ceramic substrate 110*b* may be formed of a dielectric substance having a predetermined constant. As an example, the second ceramic substrate 110*b* may be formed of a ceramic sintered material having a hexahedral shape similar to the shape of the first ceramic substrate 110*a*. The second ceramic substrate 110*b* may have a dielectric constant equal to a dielectric constant of the first ceramic substrate 110*a*. However, according to an example, the second ceramic substrate 110*b* may have a dielectric constant different from the dielectric constant of the first ceramic substrate 110*a*. As an example, the dielectric constant of the second ceramic substrate 110*b* may be higher than the dielectric constant of the first ceramic substrate 110*a*. According to an example, when the dielectric constant of the second ceramic substrate 110*b* is higher than the dielectric constant of the first ceramic substrate 110*a*, an RF signal may be radiated toward the second ceramic substrate 110*b* having a high dielectric constant to improve the gain of the RF signal.

The second ceramic substrate 110*b* may have a thickness less than a thickness of the first ceramic substrate 110*a*. For example, thickness of the first ceramic substrate 110*a* may correspond to 1 to 5 times the thickness of the second ceramic substrate 110*b* and may be, for example, 2 to 3 times the thickness of the second ceramic substrate 110*b*. As an example, the thickness of the first ceramic substrate 110*a* may be 150 μm to 500 μm, and the thickness of the second ceramic substrate 110*b* may be 100 μm to 200 μm. For example, the thickness of the second ceramic substrate 110*b* may be 50 μm to 200 μm. According to an example, the second ceramic substrate 110*b* may have a thickness equal to the thickness of the first ceramic substrate 110*a*.

According to an example, an appropriate distance between the second patch 120*b* and the third patch 120*c* and the first patch 120*a* and the third patch 120*c* is maintained depending on a thickness of the second ceramic substrate 110*b* to improve radiation efficiency of an RF signal.

The dielectric constant of the first ceramic substrate 110*a* and the second ceramic substrate 110*b* may be higher than the dielectric constant of the substrate 10, for example, the dielectric constant of the insulating layer 17 provided in the substrate 10. As an example, the dielectric constant of the first ceramic substrate 110*a* and the second ceramic substrate 110*b* may be 5 to 12 at 28 GHz, while the dielectric constant of the substrate 10 may be 3 to 4 at 28 GHz. Thus, a volume of a chip antenna may be reduced to achieve miniaturization of the entire chip antenna module. As an example, the chip antenna 100 according to an example may be manufactured in the form of a small chip having a length of 3.4 mm, a width of 3.4 mm, and a height of 0.64 mm. When the chip antenna is arranged in the form of an array of 4×1, the chip antenna module 1 according to an example may be manufactured as a small-sized module having a length of 19 mm, a width of 4.0 mm, and a height of 1.04 mm. The second patch 120*b* is provided on the other surface of the second ceramic substrate 110*b*, and the third patch 120*c* is provided on the one surface of the second ceramic substrate 110*b*.

The first ceramic substrate 110*a* and the second ceramic substrate 110*b* may be spaced apart from each other through the spacer 150. For example, the spacer 150 may be provided on each corner of the first ceramic substrate 110*a* and the second ceramic substrate 110*b* between the first ceramic substrate 110*a* and the second ceramic substrate 110*b*. According to an example, the spacer 150 may be provided on two sides including one side of the first ceramic substrate 110*a* and the second ceramic substrate 110*b* and another side facing the one side between the first ceramic substrate 110*a* and the second ceramic substrate 110*b*. Referring to FIG. 4B, the spacer 150 may be provided on four sides of the first ceramic substrate 110*a* and the second ceramic substrate 110*b*. For example, each of the spacers 150 may have a quadrilateral shape. Each of the spacers 150 between the first ceramic substrate 110*a* and the second ceramic substrate 110*b* may be provided with a hollow portion formed therein to accommodate the first patch 120*a* and the second patch 120*b* in a center thereof. The spacers 150, provided on some side among the four sides of the first ceramic substrate 110*a* and the second ceramic substrate 110*b*, may stably support the second ceramic substrate 110*b* on the first ceramic substrate 110*a*. By the spacer, a gap may be formed between the first patch 120*a*, provided on the one surface of the first ceramic substrate 110*a*, and the second patch 120*b* provided on the other surface of the second ceramic substrate 110*b*. As air having a dielectric constant of 1 fills a space formed by the gap, an overall dielectric constant of the chip antenna 100 may be reduced.

According to an example, the first ceramic substrate 110*a* and the second ceramic substrate 110*b* may be formed of a material, having a dielectric constant higher than a dielectric constant of the substrate 10, to miniaturize a chip antenna module. In addition, a gap may be formed between the first ceramic substrate 110*a* and the second ceramic substrate 110*b* to reduce an overall dielectric constant of the chip antenna 100, and thus, radiation efficiency and gain may be improved.

Figure 5A:
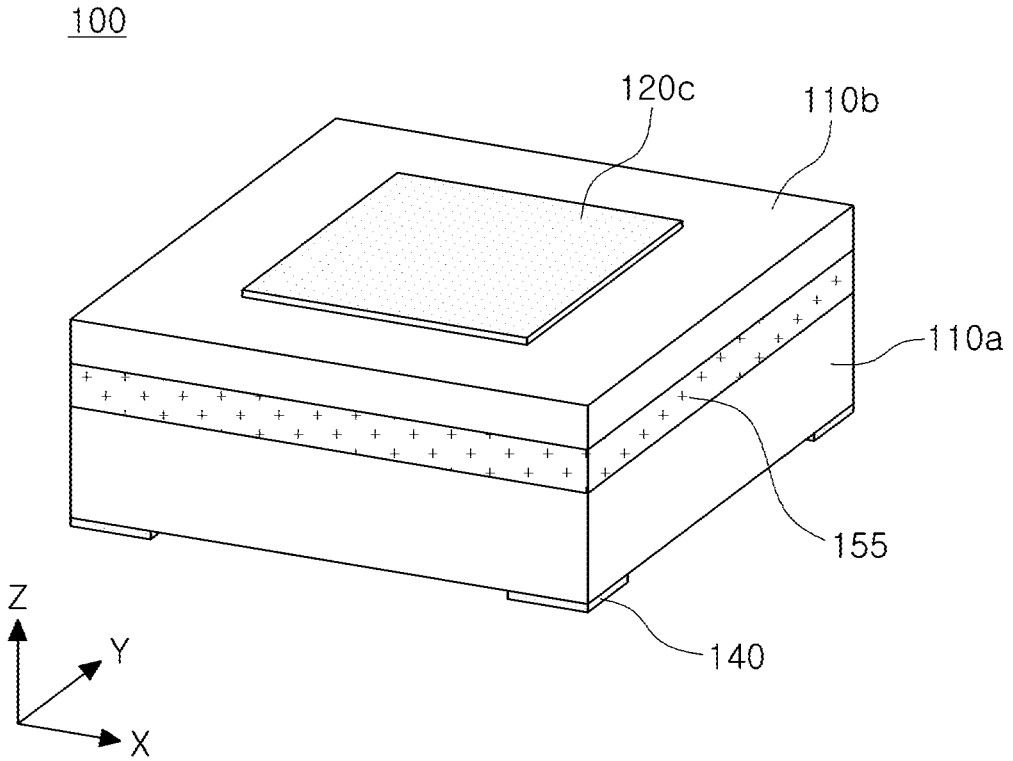
FIG. 5A is a perspective view of a chip antenna according to a second example.
Figure 5B:
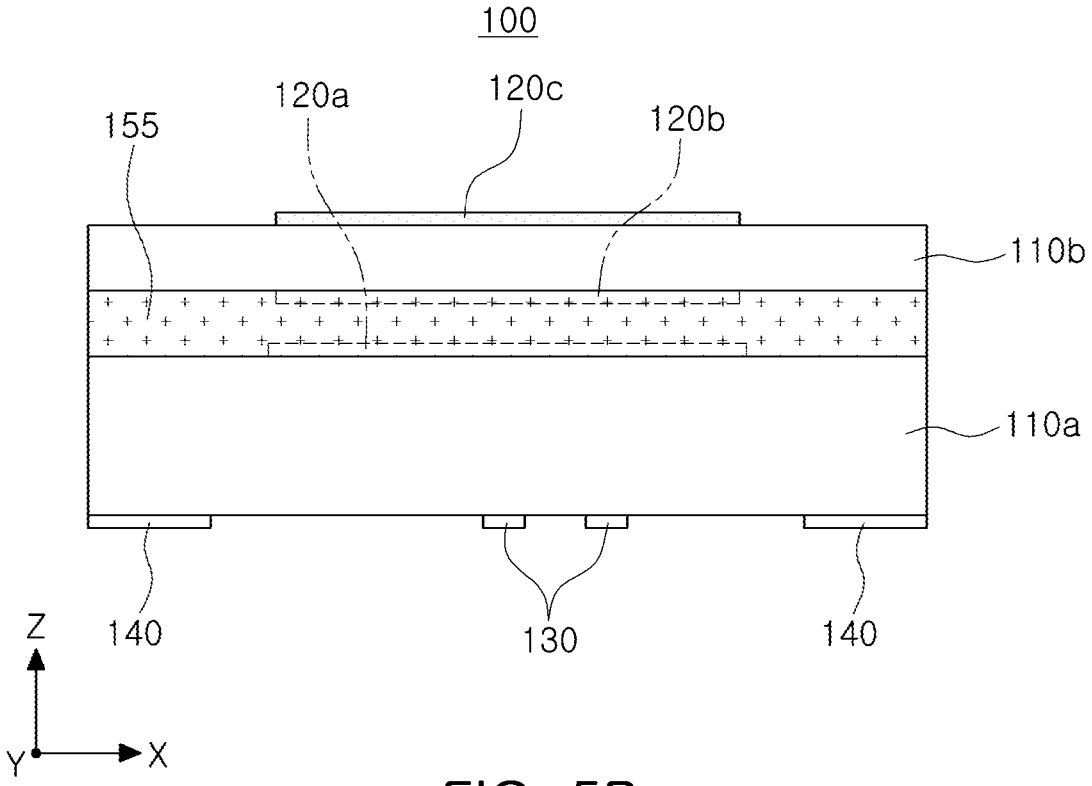
FIG. 5B is a side view of the chip antenna in FIG. 5A.
Figure 5C:
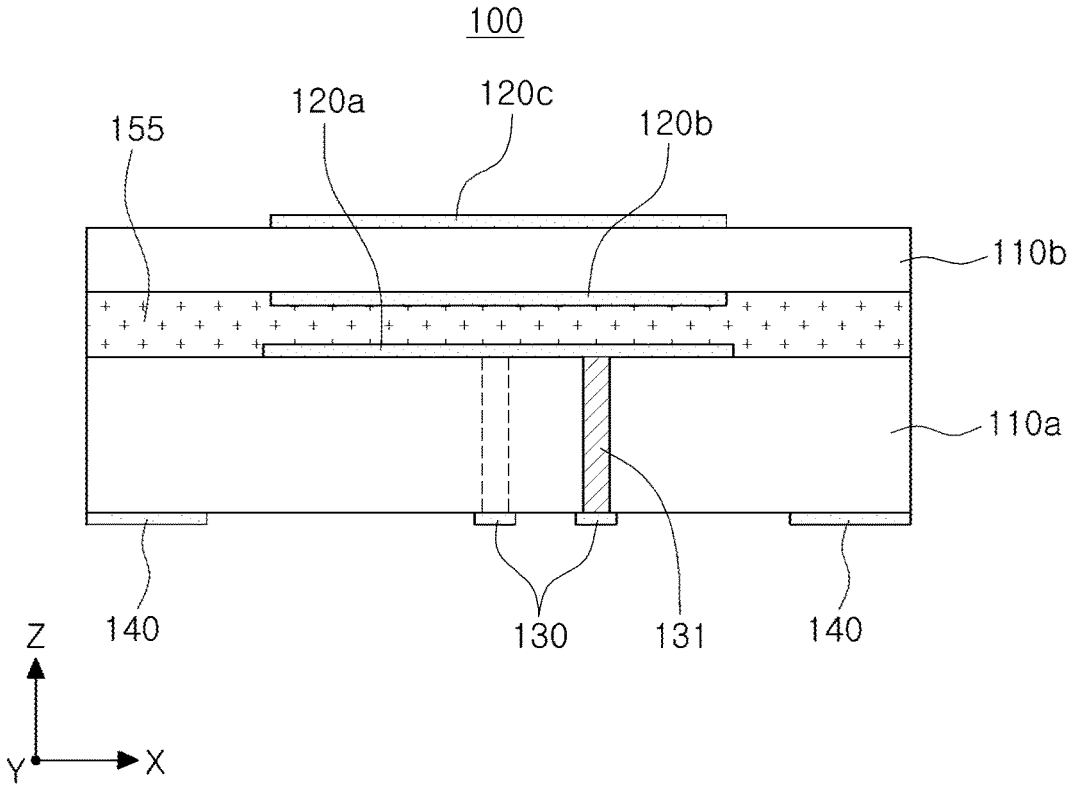
FIG. 5C is a cross-sectional view of the chip antenna in FIG. 5A.

FIG. 5A is a perspective view of a chip antenna according to a second example, FIG. 5B is a side view of the chip antenna in FIG. 5A, and FIG. 5C is a cross-sectional view of the chip antenna in FIG. 5A. Since the chip antenna according to a second example is similar to the chip antenna according to the first example, further duplicative descriptions may be omitted and differences will be mainly described.

The first ceramic substrate 110*a* and the second ceramic substrate 110*b* of the chip antenna 100 according to the first example are spaced apart from each other through the spacer 150, whereas a first ceramic substrate 110*a* and a second ceramic substrate 110*b* of a chip antenna 100 according to the second example are bonded to each other through a bonding layer 155. The bonding layer 155 according to the second example may be provided in a space formed by a gap between the first ceramic substrate 110*a* and the second ceramic substrate 110*b* according to the first example.

The bonding layer 155 may be formed to cover one surface of the first ceramic substrate 110*a* and the other surface of the second ceramic substrate 110*b*, and thus, may entirely bond the first ceramic substrate 110*a* and the second ceramic substrate 110*b* to each other. As an example, the bonding layer 155 may be formed of a polymer. As an example, the polymer may include a polymer sheet. The bonding layer 155 may have a dielectric constant lower than a dielectric constant of the first ceramic substrate 110*a* and the second ceramic substrate 110*b*. As an example, the dielectric constant of the bonding layer 155 may be 2 to 3 at 28 GHz. The bonding layer 155 may have a thickness of 50 μm to 200 μm.

According to an example, the first ceramic substrate 110*a* and the second ceramic substrate 110*b* may be formed of a material, having a dielectric constant higher than a dielectric constant of the substrate 10, to miniaturize a chip antenna module. A material, having a dielectric constant lower than a dielectric constant of the first ceramic substrate 110*a* and the second ceramic substrate 110*b*, may be provided between the first ceramic substrate 110*a* and the second ceramic substrate 110*b* to reduce an overall dielectric constant of the chip antenna 100. As a result, radiation efficiency and gain may be improved.

FIGS. 6, 7, 8, and 9 illustrate chip antennas, each including a shielding layer, according to various examples. Since the chip antennas according to examples of FIGS. 6, 7, 8, and 9 are similar to the chip antenna according to the first example illustrated in FIG. 4A and the chip antenna according to the second example illustrated in FIG. 5A, duplicate descriptions will be omitted and differences will be mainly described.

Figure 6:
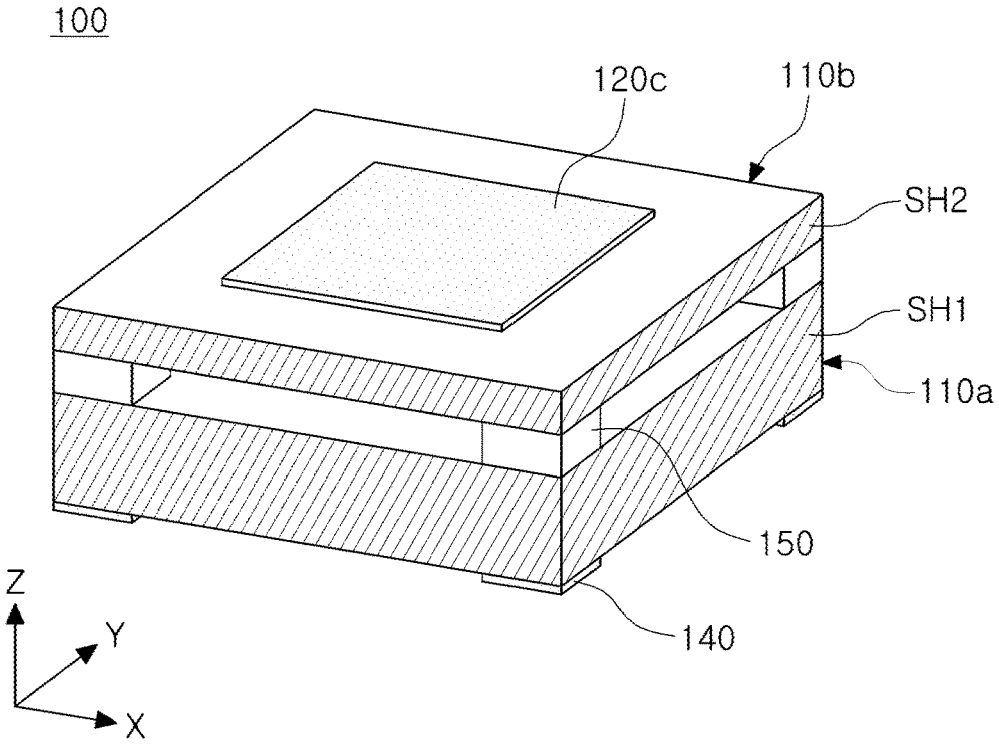
FIGS. 6, 7, 8, and 9 illustrate chip antennas, each including a shielding layer, according to various examples.
Figure 7:
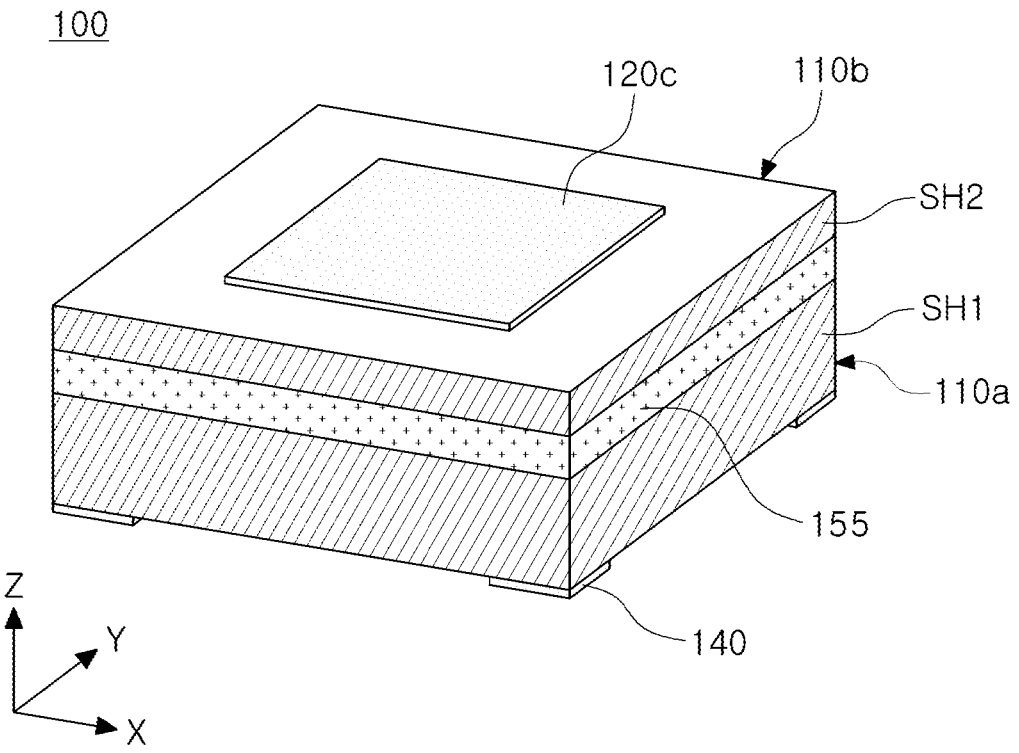
Figure 8:
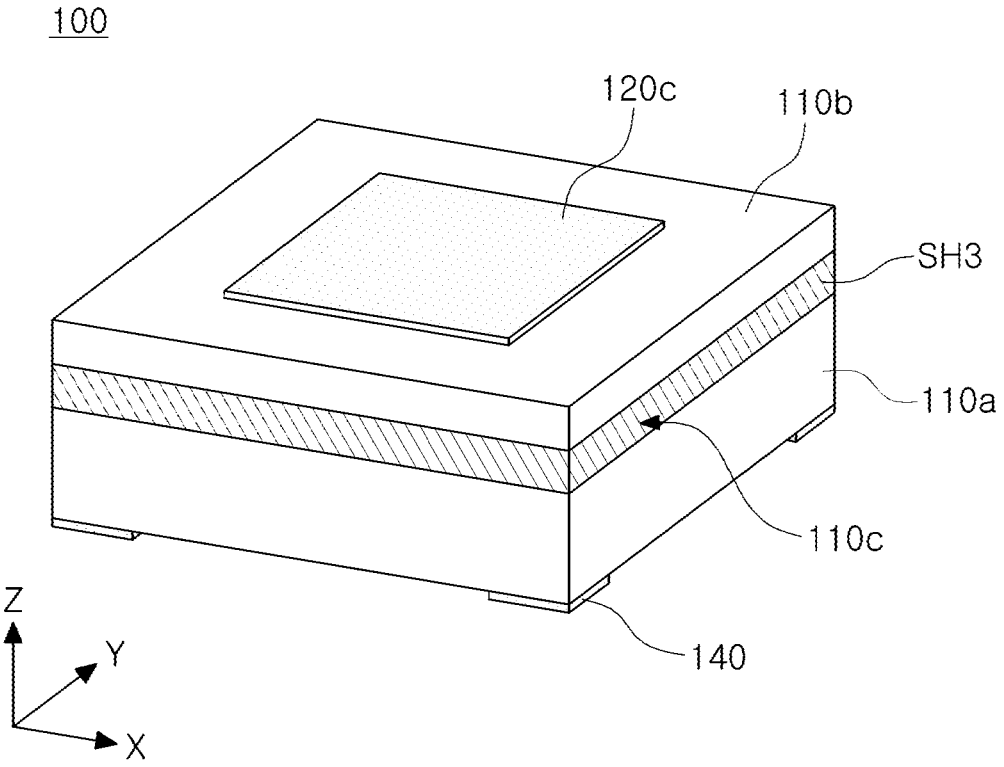
Figure 9:
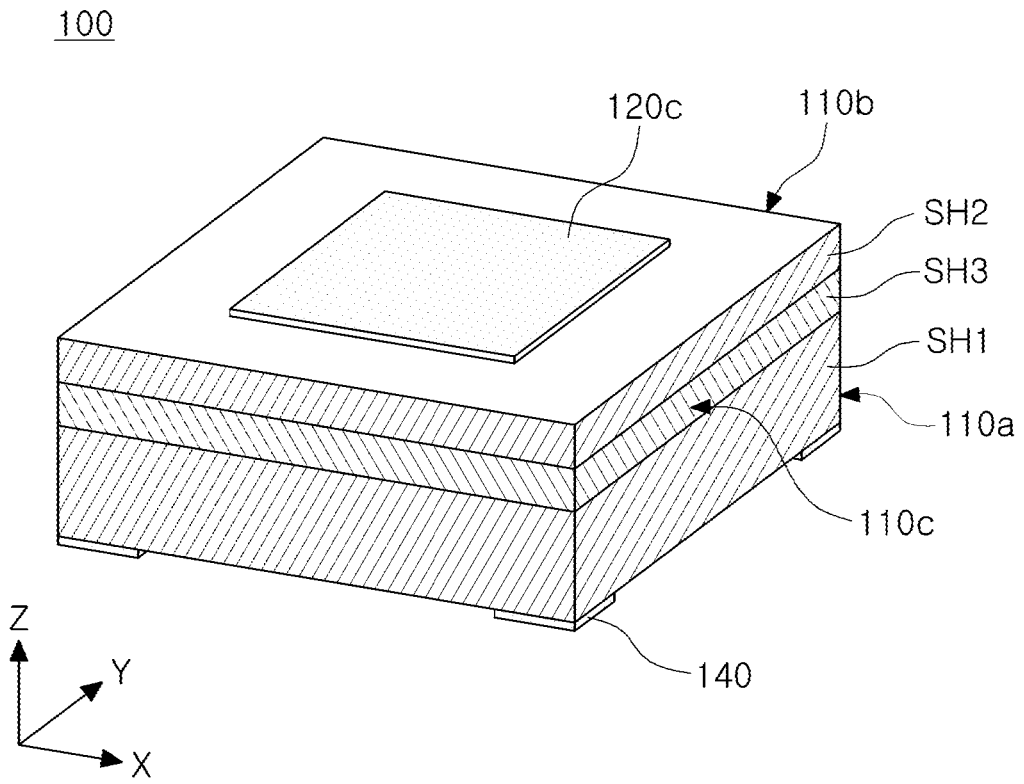

Referring to FIGS. 6 and 7, a chip antenna 100 may include a first shielding layer SH1 and a second shielding layer SH2. Referring to FIG. 8, a chip antenna 100 may include a third shielding layer SH3. Referring to FIG. 9, a chip antenna 100 may include a first shielding layer SH1, a second shielding layer SH2, and a third shielding layer SH3.

The first shielding layer SH1, the second shielding layer SH2, and the third shielding layer SH3 may reduce interference between chip antennas 100 when the chip antennas 100 are arranged in an array such as a structure of n×1.

The first shielding layer SH1 may be formed on a side surface of the first ceramic substrate 110*a*, the second shielding layer SH2 may be formed on a side surface of the second ceramic substrate 110*b*, and the third shielding layer SH3 may be formed on a side surface of an insertion member 110*c* disposed between the first ceramic substrate 110*a* and the second ceramic substrate 110*b*.

The insertion member 110*c* may be a spacer 150 provided on four sides, each having quadrilateral shape, of the first ceramic substrate 110*a* and the second ceramic substrate 110*b* of the example illustrated in FIG. 4B, and/or the bonding layer 155 of the example illustrated in FIG. 5A.

The side surfaces of the first ceramic substrate 110*a*, the second ceramic substrate 110*b*, and the insertion member 110*c* correspond to surfaces of the first ceramic substrate 110*a*, the second ceramic substrate 110*b*, and the insertion member 110*c* extending in a Z-axis direction.

The first shielding layer SH1, the second shielding layer SH2, and the third shielding layer SH3 may be formed of a conductive material. For example, the conductive material may include a metal or a polymer having conductivity. The metal of the conductive material may include one type selected from Cu, Ni, Ag, Sn, Au, or alloys formed of two or more types.

The conductive material may be provided on the entirety or a portion of the side surfaces of the first ceramic substrate 110*a*, the second ceramic substrate 110*b*, and the insertion member 110*c* through a dipping process, a coating process, a plating process, or a sputtering process to form the first shielding layer SH1, the second shielding layer SH2, and the third shielding layer SH3. Each of the first shielding layer SH1, the second shielding layer SH2, and the third shielding layer SH3 may have a thickness of 0.1 μm to 20 μm.

The first shielding layer SH1, the second shielding layer SH2, and the third shielding layer SH3 may be connected to a ground potential. When the first shielding layer SH1, the second shielding layer SH2, and the third shielding layer SH3 are connected to the ground potential, an RF signal, radiated in an X-axis direction or the Y-axis direction other than the Z-axis direction corresponding to an oriented direction may be efficiently shielded to effectively reduce the interference between the chip antennas 100. For example, the first shielding layer SH1, the second shielding layer SH2, and the third shielding layer SH3 may receive a ground potential from the ground layer 16*b* of the substrate 10.

In addition, the first shielding layer SH1, the second shielding layer SH2, and the third shielding layer SH3 may be insulated from the ground potential to be floated. When the first shielding layer SH1, the second shielding layer SH2, and the third shielding layer SH3 are floated, a radiation path in the Z-axis direction of the RF signal may be guided.

In the example of FIGS. 6 and 7, one of the first shielding layer SH1 and the second shielding layer SH2 may be connected to the ground potential, and the other shielding layer may be floated from the ground potential.

As an example, the first shielding layer SH1 may be connected to a ground potential, and the second shielding layer SH2 may be floated. The first shielding layer SH1 may be connected to a ground potential to efficiently radiate an RF signal transmitted and received through the first patch 120*a* operating as a feed patch in a horizontal direction corresponding to the X-axis direction or the Y-axis direction. The second shielding layer SH2 may be floated to guide the radiation path of the RF signal transmitted and received through the second patch 120*b* operating as a radiation patch.

Since the first shielding layer SH1 is disposed closer to the ground layer 16*b* of the substrate 10 providing the ground potential than the second shielding layer SH2, connecting the first shielding layer SH1 to the ground potential and floating the second shielding layer SH2 are advantageous for manufacturing of the chip antenna 10.

However, the example of FIGS. 6 and 7 is not limited to the first shielding layer SH1 connected to the ground potential, and the second shielding layer SH2 to be floated. According to an example, the first shielding layer SH1 may be floated and the second shielding layer SH2 may be connected to the ground potential. In addition, both the first shielding layer SH1 and the second shielding layer SH2 may be floated, or both the first shielding layer SH1 and the second shielding layer SH2 may be connected to the ground potential.

In FIGS. 6 and 7, the chip antenna 100 is illustrated as including both the first shielding layer SH1 and the second shielding layer SH2. However, according to an example, the chip antenna 100 may selectively include the first shielding layer SH1 or the second shielding layer SH2.

In an example of FIG. 8, the third shielding layer SH3 may be connected to the ground potential or may be insulated from the ground potential to be floated.

According to this example, the third shielding layer SH3 is formed on a side surface of the insertion member 110*c* disposed between the first ceramic substrate 110*a* and the second ceramic substrate 110*b*. Thus, the third shielding layer SH3 may improve radiation efficiency of an RF signal transmitted and received through the first patch 120*a* and the second patch 120*b* provided between the first ceramic substrate 110*a* and the second ceramic substrate 110*b*.

In an example of FIG. 9, the first shielding layer SH1, the second shielding layer SH2, and the third shielding layer SH3 may be connected to each other. Thus, the first shielding layer SH1, the second shielding layer SH2, and the third shielding layer SH3 may all be floated, or the first shielding layer SH1, the second shielding layer SH2, and the third shield may all be connected to a ground potential.

In FIG. 9, the chip antenna 100 is illustrated as including all of the first shielding layer SH1, the second shielding layer SH2, and the third shielding layer SH3. However, according to an example, the chip antenna 100 may include the first shielding layer SH1 and the third shielding layer SH3 and not the second shielding layer SH2, or the chip antenna 100 may include the second shielding layer SH2 and the third shielding layer SH3 and not the first shielding layer SH1.

Referring to FIGS. 6, 7, 8, and 9, each of the first shielding layer SH1, the second shielding layer SH2, and the third shielding layer SH3 may be formed on an entire side surface of each of the first ceramic substrate 110*a*, the second ceramic substrate 110*b*, and the insertion member 110*c*. According to an example, each of the first shielding layer SH1, the second shielding layer SH2, and the third shielding layer SH3 may be formed on a portion of a side surface of each of the first ceramic substrate 110*a*, the second ceramic substrate 110*b*, and the insertion member 110*c*, respectively.

Figure 10A:
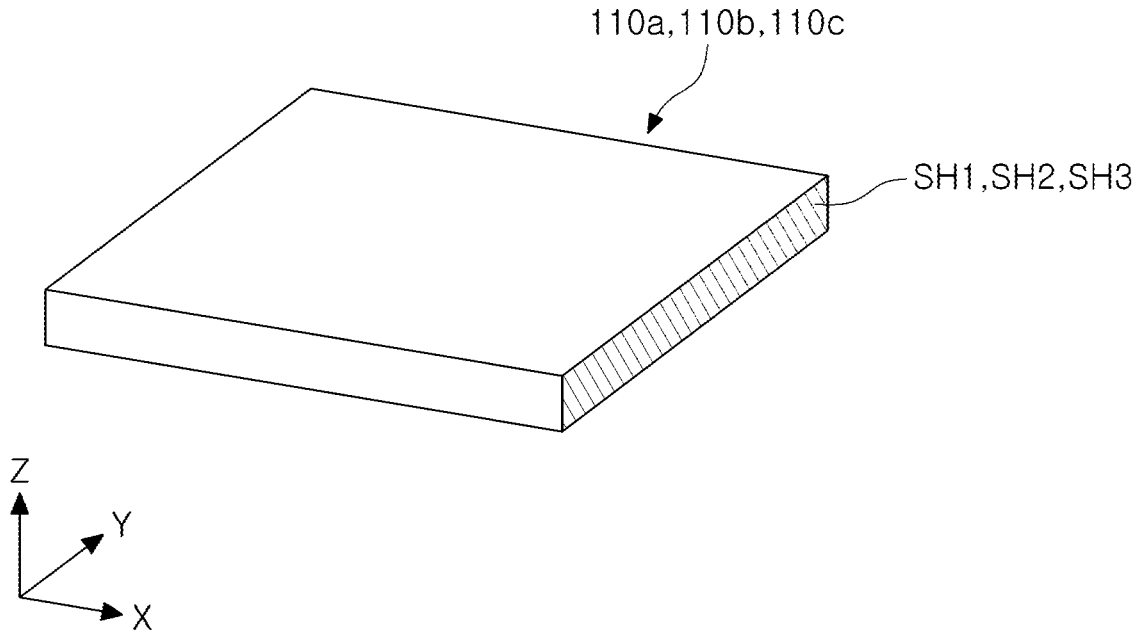
FIGS. 10A and 10B illustrate modified examples of a shielding layer according to various examples.
Figure 10B:
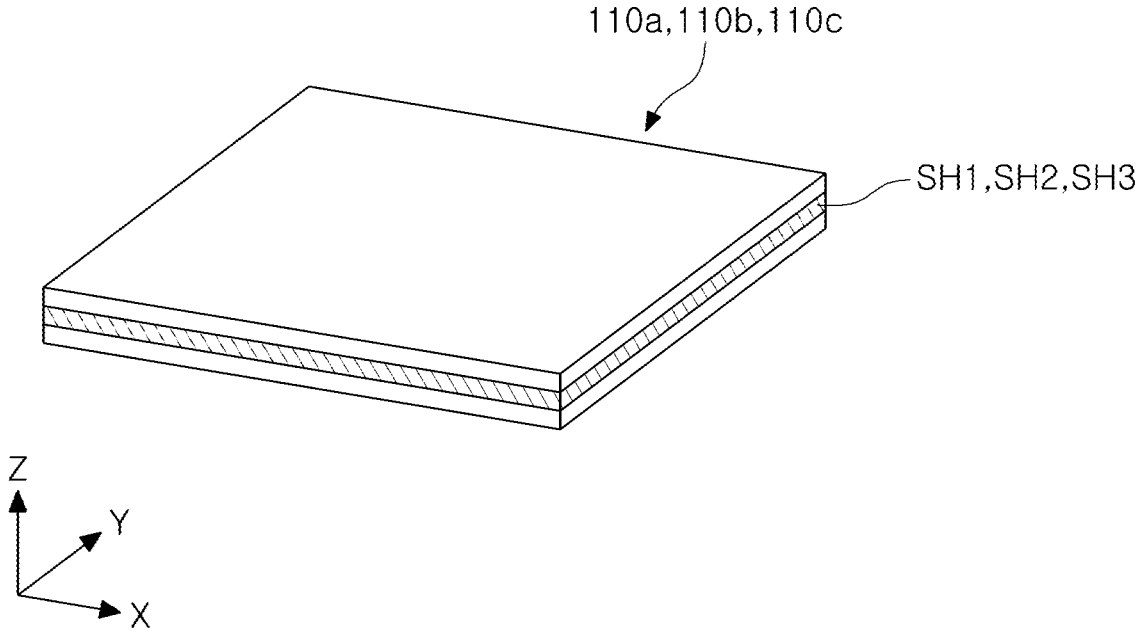

FIGS. 10A and 10B are provided to describe modified examples of a shielding layer according to various examples.

In FIGS. 10A and 10B, structures of a first shielding layer SH1, a second shielding layer SH2, and a third shielding layer SH3 are similar to each other. Therefore, for ease of description, a modified example of a shielding layer of the present disclosure will now be described with the focus on the first shielding layer SH1. However, it will be appreciated that the description of the first shielding layer SH1 to be described later may be applied to the second shielding layer SH2 and the third shielding layer SH3.

In an example, the first shielding layer SH1 may be formed in a portion of the first ceramic substrate 110*a* in a circumferential direction, on a side surface of the first ceramic substrate 110*a*. The term "circumferential direction" may be understood as a direction toward an edge of a shape of the first ceramic substrate 110*a* on a plane determined by an X axis and a Y direction. Referring to FIG. 10A, when the first ceramic substrate 110*a* is formed to have a quadrilateral shape, the first shielding layer SH1 may be formed on one surface of a side surface, extending in the Y axis direction, of the first ceramic substrate 110*a*.

In an example, the first shielding layer SH1 may be formed in a portion of the first ceramic substrate 110*a* in a thickness direction. As an example, referring to FIG. 10B, the first shielding layer SH1 may be formed in a portion of the side surface of the first ceramic substrate 110*a* in a Z-axis direction.

Figure 11:
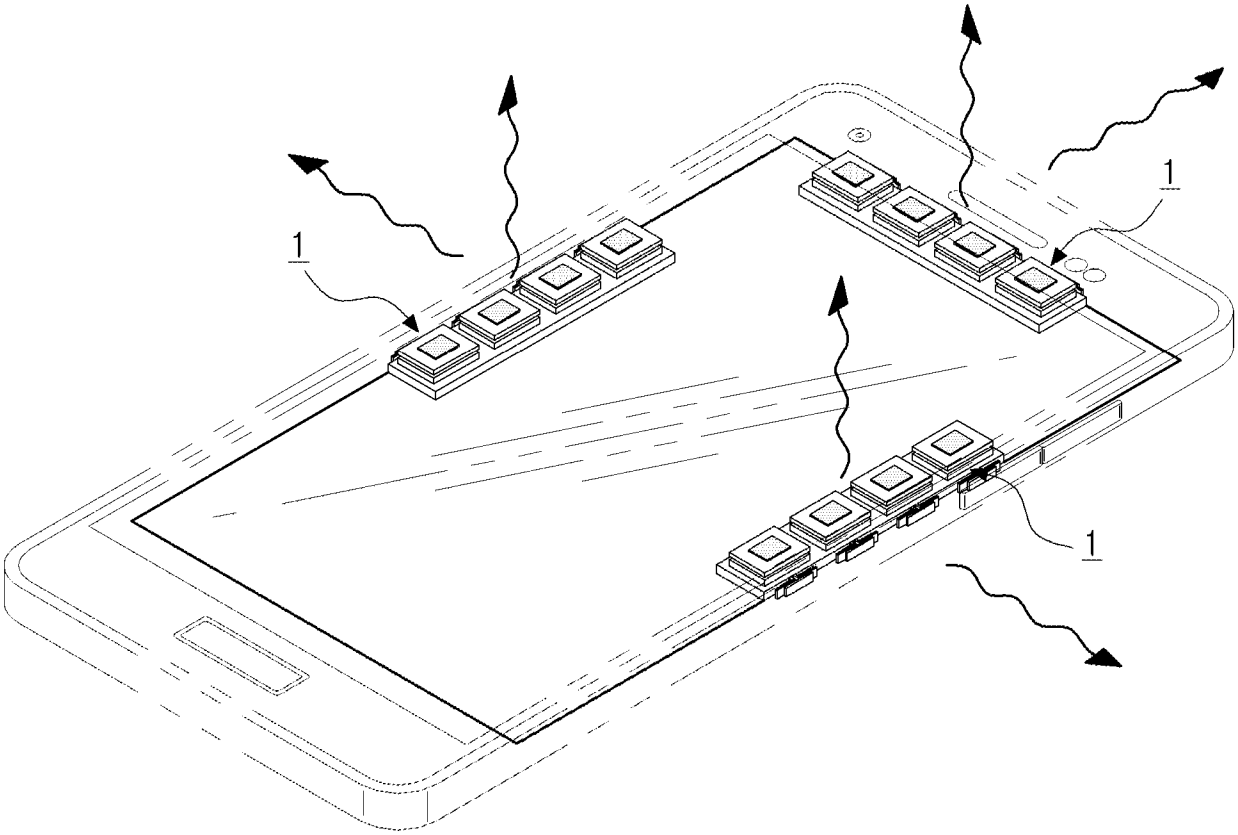
FIG. 11 is a schematic perspective view illustrating a mobile terminal on which a chip antenna module according to an example is mounted.

FIG. 11 is a schematic perspective view illustrating a mobile terminal on which a chip antenna module according to an example is mounted.

Referring to FIG. 11, a chip antenna module 1 of an example is disposed adjacent to an edge of a mobile terminal. As an example, chip antenna modules 1 are disposed to oppose each other on sides in a length direction or sides in a width direction. In this example, the case in which chip antenna modules are disposed on two sides in a length direction and one side in a width direction, of a mobile terminal, is described by way of example, but the example is not limited thereto. When an internal space of the mobile terminal is insufficient, two chip antenna modules may be only disposed in a diagonal direction of the mobile terminal. As described above, the disposition structure of chip antenna modules may be modified in various forms as needed. An RF signal, radiated through a chip antenna of the chip antenna module 1, may be radiated in a thickness direction of a mobile terminal. An RF signal, radiated through an end-fire antenna of the chip antenna module 1, may be radiated in a direction perpendicular to a side of the mobile phone in a length direction or a side of the mobile phone in a width direction.

As described above, according to an example, interference between chip antennas, arranged in an array form, may be reduced to improve the radiation efficiency.

While specific examples have been shown and described above, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A chip antenna comprising:

a first substrate;

a second substrate disposed to oppose the first substrate;

a patch including a conductive material and disposed between the first substrate and the second substrate;

an insertion member disposed to form a dielectric medium having a dielectric constant lower than dielectric constants of first and second substrates between the first substrate and the second substrate; and a shielding layer disposed on a side surface of the insertion member.

2. The chip antenna of claim 1, wherein the shielding layer is disposed on an entire side surface of the insertion member.

3. The chip antenna of claim 1, wherein a portion of the side surface of the insertion member is exposed outside of the shielding layer.

4. The chip antenna of claim 3, wherein the shielding layer extends in a circumferential direction of the insertion member, on the side surface of the insertion member.

5. The chip antenna of claim 3, wherein the shielding layer extends in a thickness direction of the insertion member, on the side surface of the insertion member.

6. The chip antenna of claim 1, wherein the insertion member comprises one or more of a spacer and a bonding layer disposed on the one surface of the first substrate and the one surface of the second substrate.

7. The chip antenna of claim 1, wherein the dielectric constant of the dielectric medium comprises a dielectric constant of air.

8. The chip antenna of claim 7, wherein the air included in the dielectric medium is exposed outside of the shielding layer.

9. The chip antenna of claim 1, wherein the insertion member includes a polymer, and at least one of the first and second substrates includes a ceramic.

10. The chip antenna of claim 1, further comprising a bonding pad disposed on a lower surface of the first substrate and electrically connected to the shielding layer, and wherein the patch is disposed on an upper surface of the first substrate.

11. The chip antenna of claim 1, further comprising a bonding pad disposed on a lower surface of the first substrate and separated from the shielding layer, and wherein the patch is disposed on an upper surface of the first substrate.

12. A chip antenna comprising:

a first substrate;

a second substrate disposed to oppose the first substrate;

a patch including a conductive material and disposed between the first substrate and the second substrate;

a first shielding layer disposed on a side surface of the first substrate; and a second shielding layer disposed on a side surface of the second substrate, wherein at least a portion of a dielectric medium between the first and second substrates is exposed outside of the first and second shielding layers.

13. The chip antenna of claim 12, wherein the first shielding layer is disposed on an entire side surface of the first substrate, and the second shielding layer is disposed on an entire side surface of the second substrate.

14. The chip antenna of claim 12, wherein a portion of the side surface of at least one of the first and second substrates is exposed outside of the shielding layer.

15. The chip antenna of claim 14, wherein the first shielding layer extends in a circumferential direction of the first substrate, on the side surface of the first substrate, and the second shielding layer extends in a circumferential direction of the second substrate, on the side surface of the second substrate.

16. The chip antenna of claim 14, wherein the first shielding layer extends in a thickness direction of the first substrate, on the side surface of the first substrate, and the second shielding layer extends in a thickness direction of the second substrate, on the side surface of the second substrate.

17. The chip antenna of claim 12, further comprising a bonding pad disposed on a lower surface of the first substrate and electrically connected to the first shielding layer, and wherein the patch is disposed on an upper surface of the first substrate.

18. The chip antenna of claim 17, wherein the first and second shielding layers are separated from each other.

19. The chip antenna of claim 12, wherein the dielectric medium between the first and second substrates includes at least one of air and an insulating material.

20. The chip antenna of claim 12, wherein at least one of the first and second substrates includes a ceramic having a dielectric constant higher than a dielectric constant of an insulating material of the dielectric medium between the first and second substrates.

* * * * *